US009243871B2

(12) United States Patent
Carter et al.

(10) Patent No.: US 9,243,871 B2
(45) Date of Patent: Jan. 26, 2016

(54) PERSONAL LOAD CARRYING RELEASE

(76) Inventors: Paul Carter, Fayetteville, NC (US); Andreas Hoertnagl, Fulpmes (AT)

( * ) Notice: Subject to any disclaimer, the term of this patent is extended or adjusted under 35 U.S.C. 154(b) by 1142 days.

(21) Appl. No.: 12/994,140

(22) PCT Filed: May 22, 2009

(86) PCT No.: PCT/US2009/045044

§ 371 (c)(1),
(2), (4) Date: Feb. 14, 2011

(87) PCT Pub. No.: WO2009/143464

PCT Pub. Date: Nov. 26, 2009

(65) Prior Publication Data

US 2011/0127307 A1 Jun. 2, 2011

Related U.S. Application Data

(60) Provisional application No. 61/055,267, filed on May 22, 2008, provisional application No. 61/153,545, filed on Feb. 18, 2009.

(51) Int. Cl.

| | |
|---|---|
| ***A45F 5/00*** | (2006.01) |
| ***F16B 21/00*** | (2006.01) |
| ***F41H 1/02*** | (2006.01) |
| *A44B 11/25* | (2006.01) |

(52) U.S. Cl.

CPC ..... *F41H 1/02* (2013.01); *A44B 11/2546* (2013.01); *Y10T 24/45461* (2015.01); *Y10T 24/45466* (2015.01); *Y10T 24/45628* (2015.01); *Y10T 24/45644* (2015.01); *Y10T 24/45675* (2015.01); *Y10T 29/49815* (2015.01); *Y10T 74/2042* (2015.01); *Y10T 403/591* (2015.01)

(58) Field of Classification Search

CPC . A44B 11/2546; F41H 1/02; Y10T 24/45466; Y10T 24/45461; Y10T 24/45634; Y10T 24/45675; Y10T 24/45644

USPC ..... 24/602, 603, 643, 635, 637

See application file for complete search history.

(56) References Cited

U.S. PATENT DOCUMENTS

| | | | | |
|---|---|---|---|---|
| 3,188,707 | A * | 6/1965 | Schmidt | 24/606 |
| 3,872,556 | A * | 3/1975 | Frost | 24/603 |
| 4,468,843 | A * | 9/1984 | Duclos et al. | 24/642 |
| 5,182,836 | A * | 2/1993 | Burkat | 24/603 |
| 6,247,427 | B1 * | 6/2001 | DeBien | 119/776 |
| 6,487,761 | B2 | 12/2002 | Van Tassel | |
| 6,955,138 | B2 * | 10/2005 | DeBien | 119/776 |
| 7,162,978 | B2 * | 1/2007 | Debien | 119/772 |
| 8,256,020 | B2 * | 9/2012 | Dovner et al. | 2/2.5 |
| 2002/0092140 | A1 * | 7/2002 | Van Tassel | 24/614 |

* cited by examiner

*Primary Examiner* — Robert J Sandy

(57) ABSTRACT

Release of attachment assemblies. Attachment assemblies including releasing mechanism, a trigger; and cables in mechanical communication with the releasing mechanism and with the trigger for operation of each releasing mechanism having such mechanical communication.

2 Claims, 32 Drawing Sheets

PERSONAL LOAD CARRYING RELEASE

CROSS REFERENCE TO RELATED APPLICATIONS

This application claims the benefit of U.S. Provisional Application No. 61/153,545, tiled Feb. 18, 2009 and U.S. Provisional Application No. 61/055,267, filed May 22, 2008; each of which is incorporated herein in its entirety by reference.

FIELD OF THE INVENTION

The present technology relates to a release assembly for use with one or more attachment assemblies in personal load carrying systems. More particularly, the technology relates to a system and method of detaching one or more attachment assemblies from a single, remotely-located release assembly with trigger.

BACKGROUND OF THE INVENTION

Currently, soldiers are issued large quantities of equipment to increase lethality, survivability, mobility and target acquisition capabilities. Often, little consideration is given to item deployment, storage, transport or utilization. A soldier may therefore find himself forced to place items in hard-to-reach locations when securing issued equipment to his person. This can lead to inefficiencies in both carrying equipment and accessing equipment for use. Without the ability to quickly detach necessary items from a soldier's person, a soldier's life may be unnecessarily endangered. Moreover, detached items must be easily reattached. A system and method of attaching and quickly detaching multiple pieces of equipment to a soldier is, therefore, required.

SUMMARY OF THE INVENTION

Accordingly, the present technology has been achieved to solve the above problems and carry out a further improvement. The technology includes systems and methods of attaching and quickly detaching a number of items. The technology involves a plurality of releasable attachment assemblies. Each attachment assembly includes a releasing means, at least one trigger, and a plurality of connection assemblies. Each connection assembly is in communication with a releasing means an attachment assembly, and in communication with the trigger for operation of each releasing means having such communication.

DETAILED DESCRIPTION

Reference will now be made in detail to embodiments of the technology. Each example is provided by way of explanation of the technology only, not as a limitation of the technology. It will be apparent to those skilled in the art that various modifications and variations can be made in the present technology without departing from the scope or spirit of the technology. For instance, features described as part of one embodiment can be used on another embodiment to yield a still further embodiment. Thus, it is intended that the present technology cover such modifications and variations that come within the scope of the technology. While the Background described military applications, the technology finds use in other applications where an individual bears loads that are desirably releasable, e.g., mountaineering, law enforcement.

Figure 1:
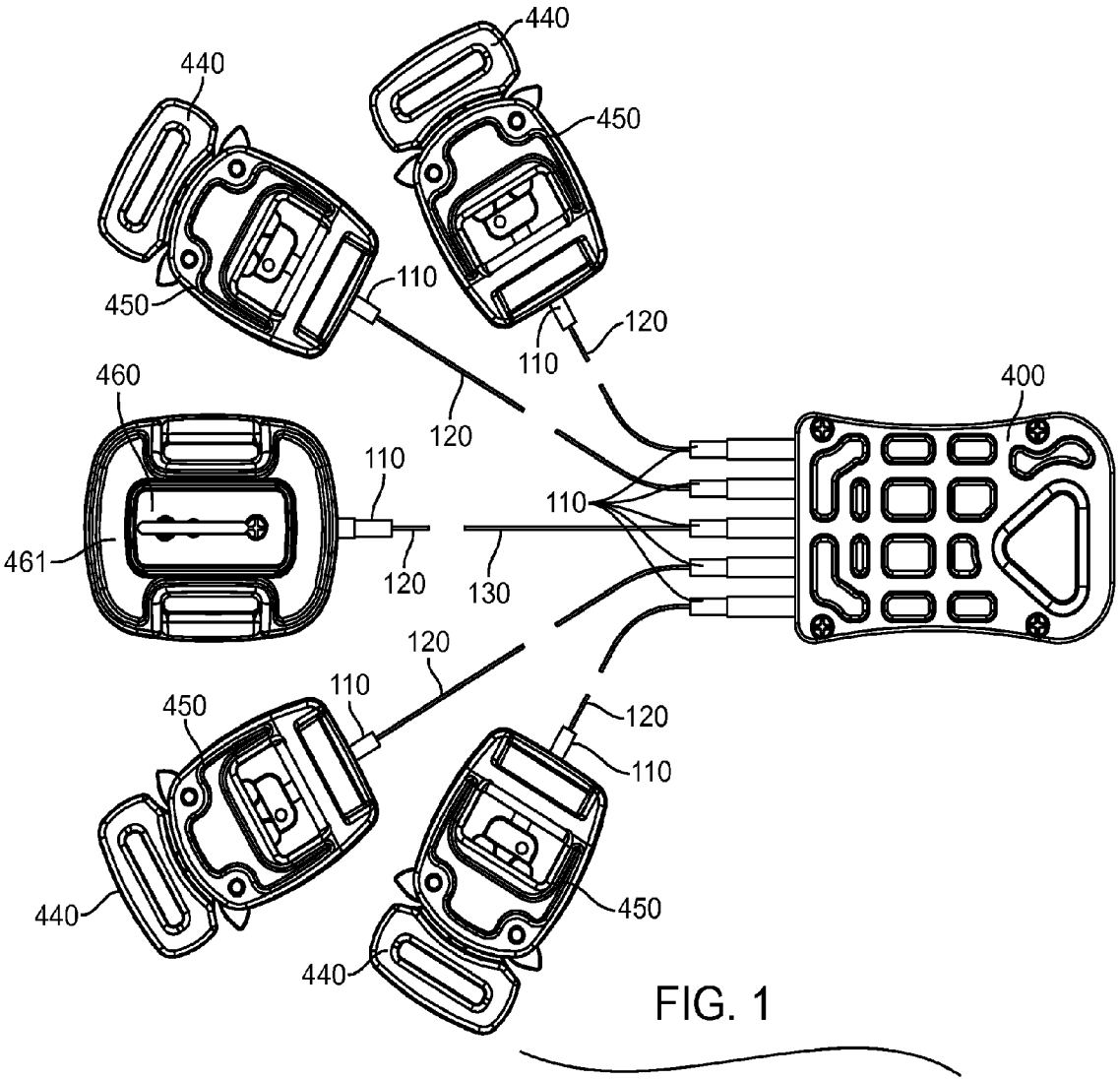
FIG. 1 illustrates an overview of embodiments of the technology.
Figure 6:
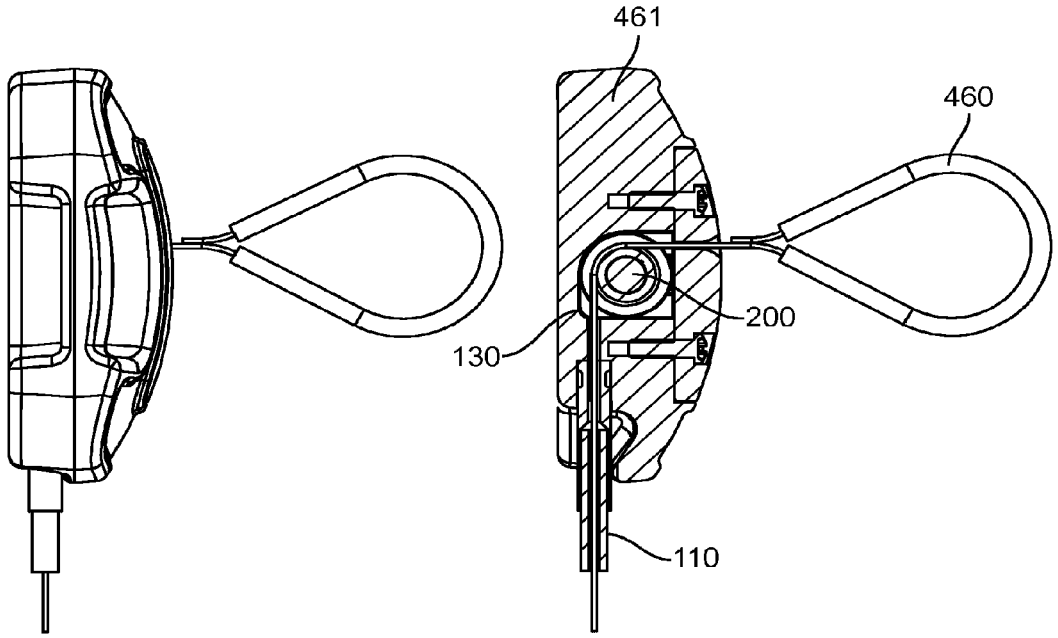
FIG. 6 illustrates an overview of embodiments where trigger and relay are combined.

FIG. 1 shows a first embodiment of the technology. A trigger housing 461 carries a trigger 460. The trigger 460 is connected to an inner trigger cable 130 guided in an outer cable 110. One arrangement of connecting the trigger 460 to the inner trigger cable 130 is shown in FIG. 6. In this arrangement the trigger 460 is directly connected to the inner trigger cable 130 that is directed around a roller 200 inside the trigger housing 461 before it enters the outer cable 110 that is fixed to the trigger housing 461.

Referring again to FIG. 1, the inner trigger cable 130 is directed into the trigger relay 400 which is a compensation means. Several attachment assemblies, each having a male portion 440 and a female portion 450 are connected to the trigger relay 400 by inner cables 120 guided in outer cables 110. The outer cables 110 are each fixed to respective female portions 450 and the trigger relay 400 and are one piece outer cables as indicated by broken lines. The inner trigger cable 130 and the inner cables 120 are more or less inductile with respect to their length direction preferably but flexible in other directions. The collection of cables (both inner and outer), fluid or gaseous transmission media (discussed below), and associated hardware between the trigger and the attachment assemblies also are referred to herein as a connection assembly.

Figure 2:
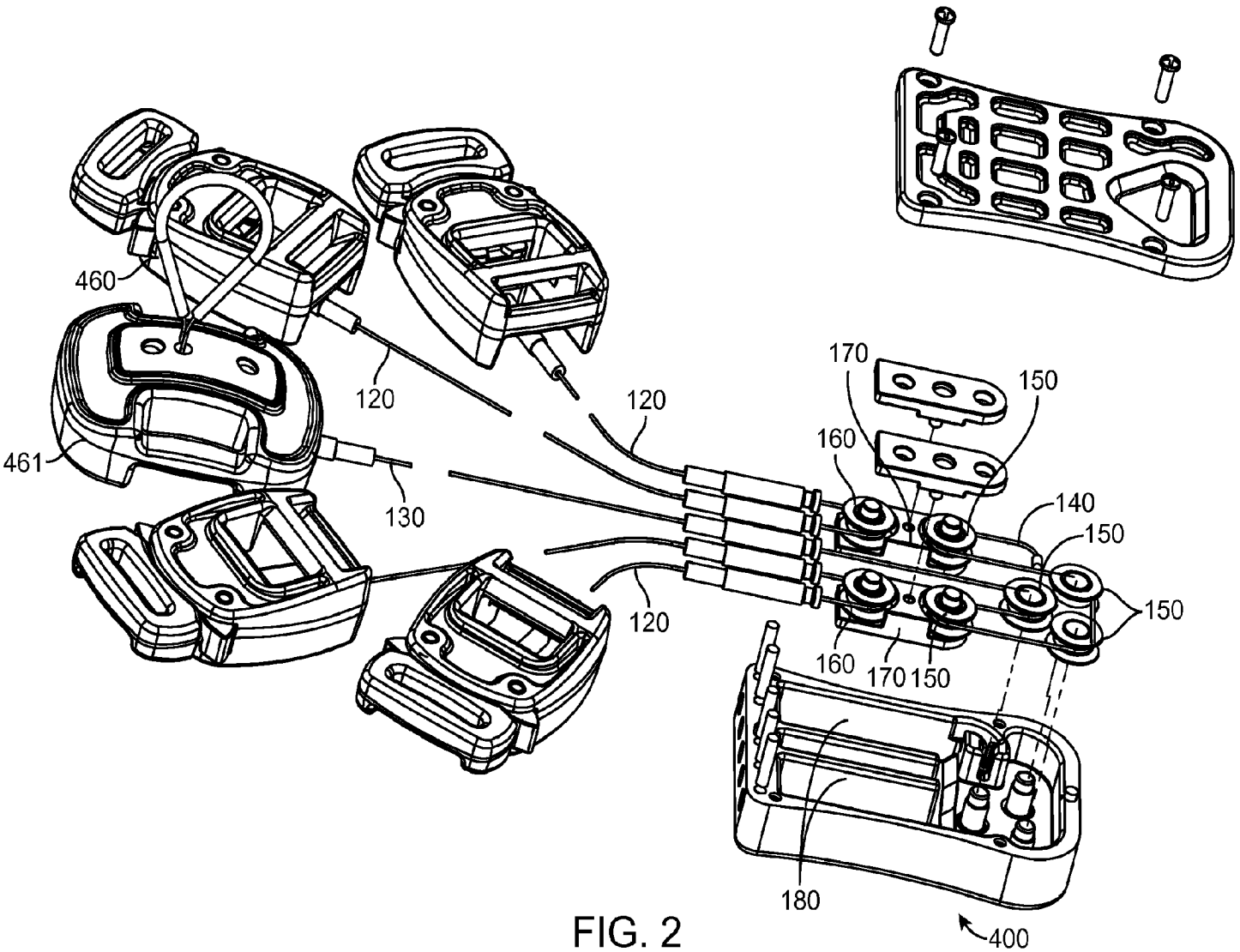
FIG. 2 illustrates a view of the embodiments of the technology with the relay exploded.

FIG. 2 shows an interior of the trigger relay 400. The inner trigger cable 130 of this embodiment is directed over five first rollers 150 and secured to the housing of the remote trigger assembly 400 by fixture 140. The inner cables 120 are guided over second rollers 160. Two sliding members 170 are guided in slots 180 in the housing of the trigger relay 400. Each sliding member 170 carries one first roller 150 and one second roller 160. If the trigger 460 is pulled, the two sliding members 170 are displaced in the slots 180. Due to that, the second rollers 160 pull on the inner cables 120.

Figure 3:
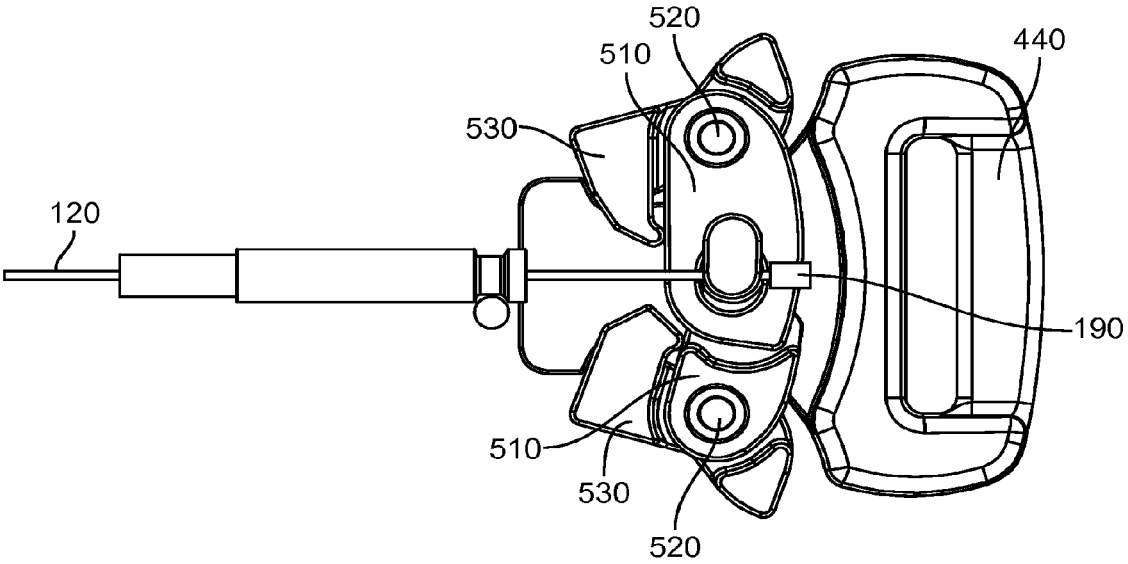
FIG. 3 illustrates a detail view of a 4-lever embodiment of an attachment mechanism of the technology which can for example be used in the embodiment of FIG. 1 and FIG. 2.
Figure 4:
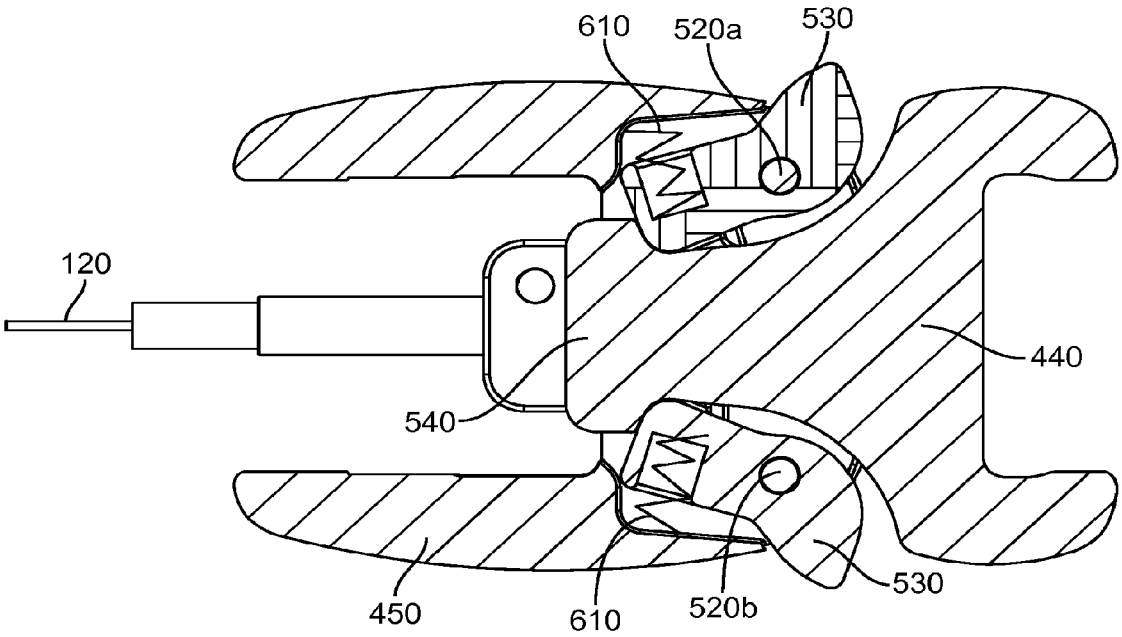
FIG. 4 illustrates a cutaway view of the 4-lever embodiment of an attachment mechanism of the technology of FIG. 3.

FIGS. 3 and 4 show the interior of an attachment assembly from two different sides. The end 190 of the inner cable 120 is fixed to one of the two first levers 510. The two first levers 510, which are coupled by coupling member 550, can be rotated around axis 520*a* and 520*b* by pulling on the inner cable 120; the axis 520*a* and 520*b* being fixed to the housing of the female portion 450 of the attachment assembly. Second levers 530 are each coupled to one of the first levers 510 in a way that they rotate together with the respective first lever 510. FIG. 3 and FIG. 4 show a first position in which the second levers 530 are engaged with respective shoulders of the T-shaped front end 540 of the male portion 440 and form a releasing means. In a second (release) position the second levers 530 are rotated away from said shoulders of the front end 540 by pulling the inner cable 120, e.g., in FIG. 4, clockwise about 520*a* and counterclockwise about 520*b*. The levers can also be moved to the release position by applying pressure to the exposed end 560 of each lever 530 to counter the biasing provided by the spring 610. In this second position the male portion 440 is no longer retained by the female portion 450 of the attachment assembly. Springs 610 "Feder" are each situated between each lever 530 and the female portion 450 of the attachment assembly. In the embodiment with the four levers 510 and 530 both levers 530 have to be operated in a case when the levers 530 are operated by pressing on exposed ends 560 in order to release the male portion 440 from the female portion 450. if only one exposed end 560 is pressed on, the other lever 530 remains engaged with said shoulder of front end 540.

Figure 10:
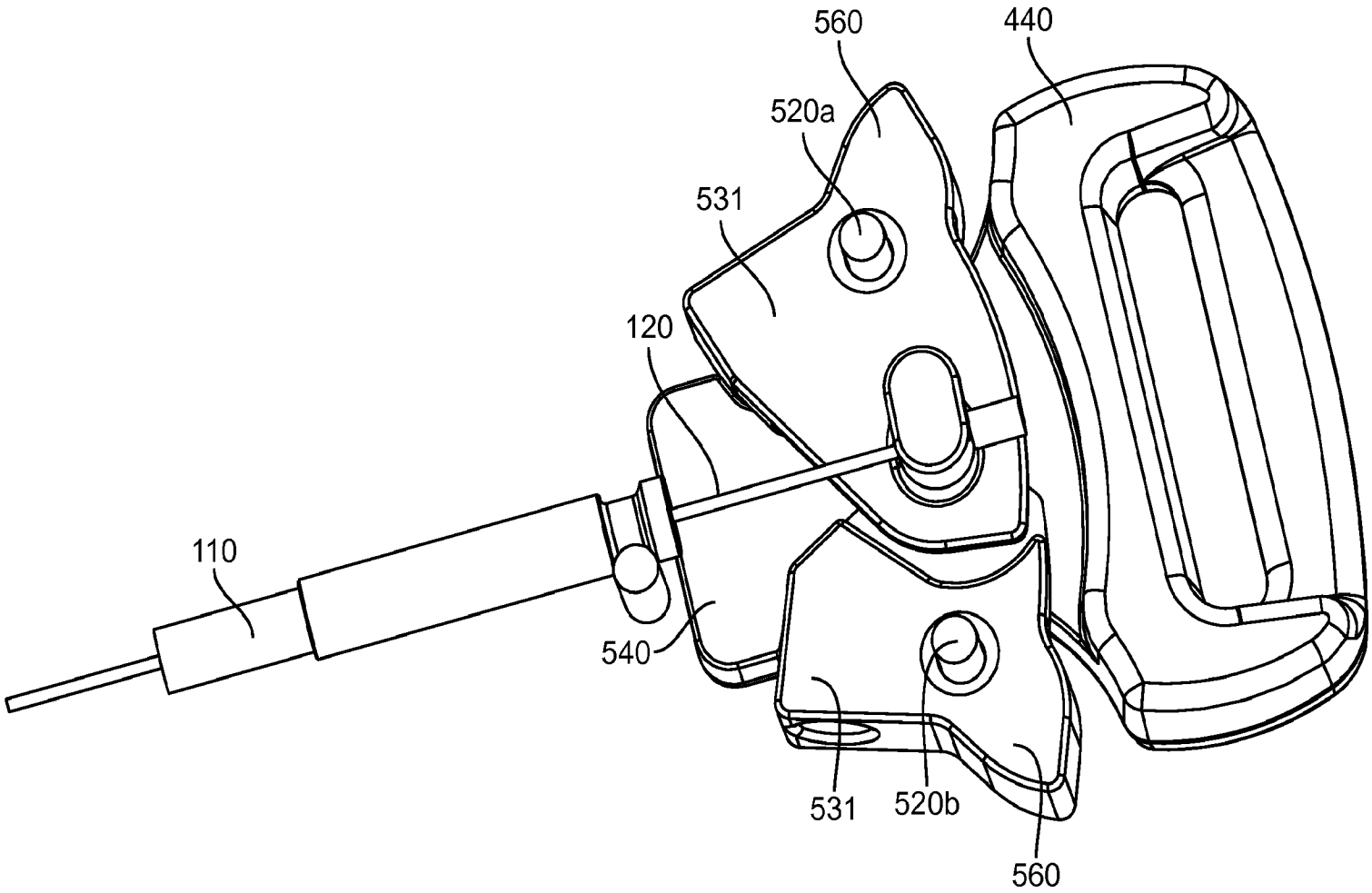
FIG. 10 illustrates 2-lever embodiments of attachment mechanisms of the technology.
Figure 11:
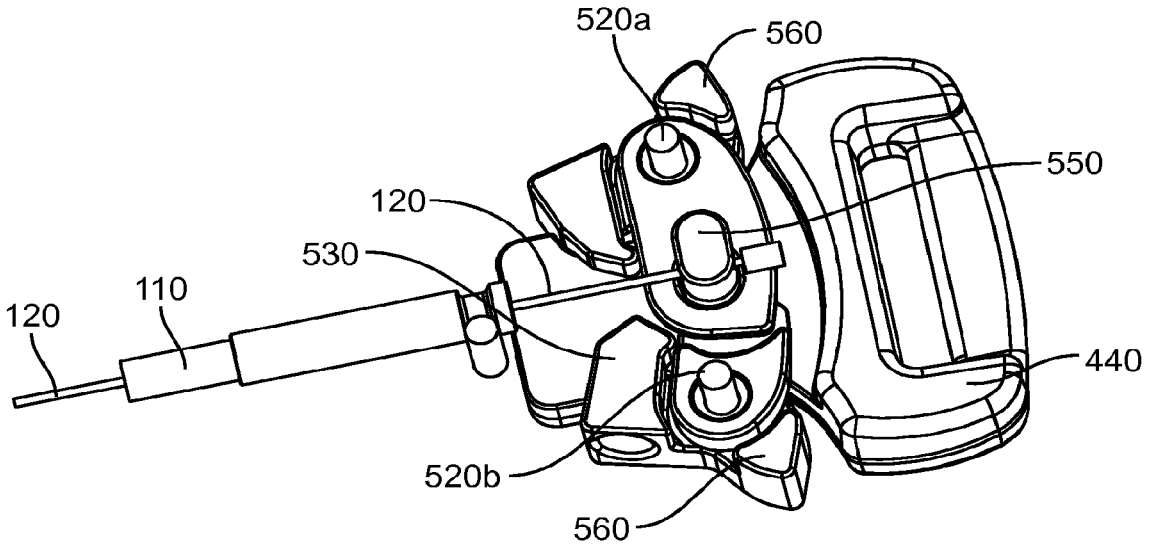
FIG. 11 illustrates 4-lever embodiments of attachment mechanisms of the technology.

In alternative embodiments, each first lever 510 is made as one piece together with one second lever 530. In this configuration, shown e.g., in drawing FIG. 10, the male portion is no longer retained by the female portion if sufficient pressure is applied to one or two of the exposed ends 560 of the one-piece levers 531.

Though the figures show four (4) attachment assemblies, the technology can be operative with as few as one (1) attachment assembly, or any other number of attachment assemblies—still providing remote release. An uneven number of attachments assemblies can be accommodated by terminating one end of a cable 120 at the trigger relay 400, e.g., with a post.

Figure 5:
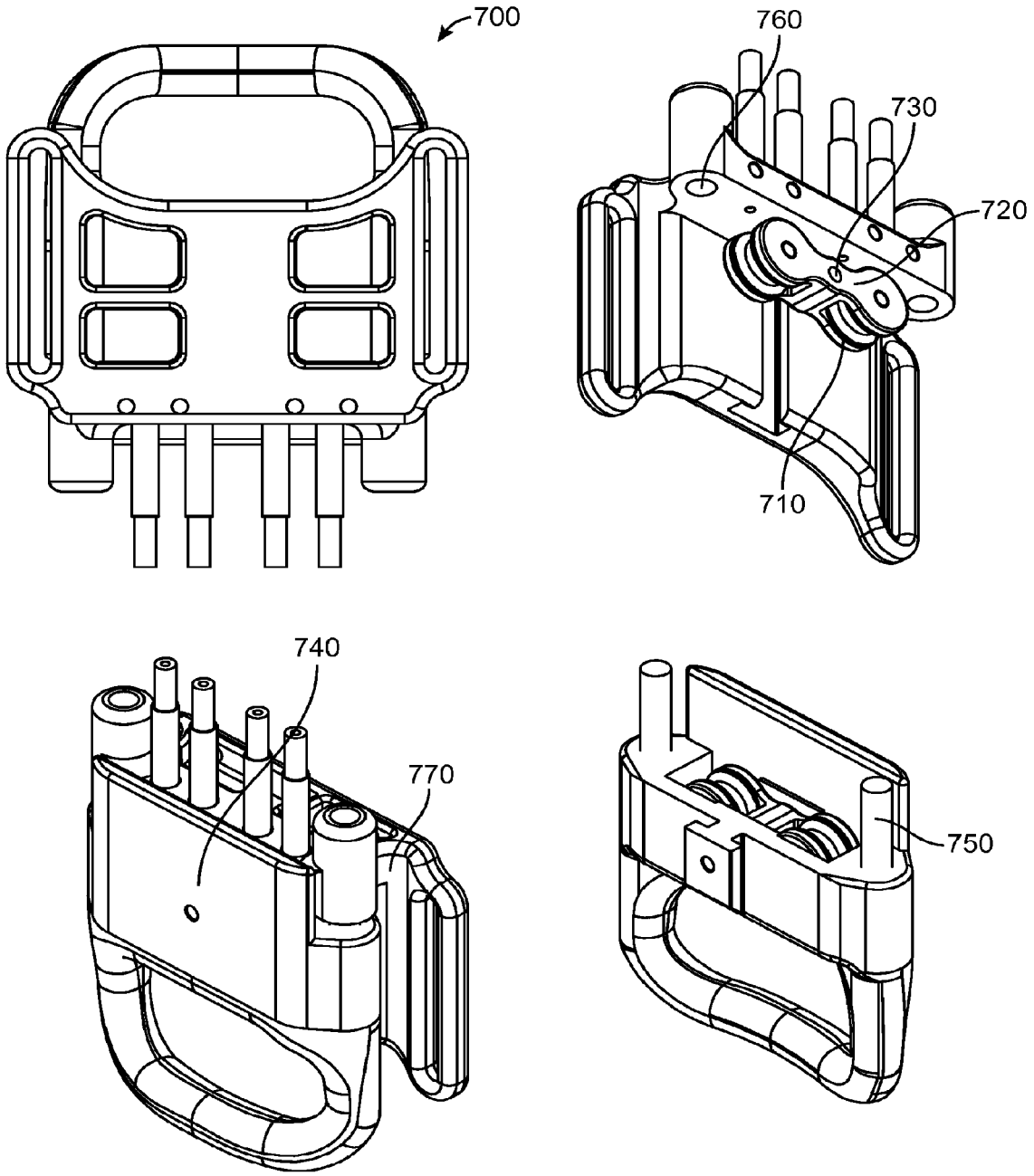
FIG. 5 illustrates an overview of embodiments where the trigger and relay are combined.

FIG. 5 shows embodiments in which the trigger relay and the trigger housing are combined in one part 700. In these embodiments, it is not necessary to have an inner trigger cable 130 as in the embodiments where the relay 400 and housing 461 are separate. The inner cables 120 are not shown in FIG. 5, but they are directed around rollers "Rolle" 710 of the compensator "Ausgleichswippe" 720. The compensator 720 is fixed to the trigger Betatingungsheble 740 (though FIG. 5 shows the compensator 720 in its relation to the base 770 when the base and Betatigungshebel are assembled) by a swivel axis "Schwenkachse" 730. The compensator "Ausgleichswippe" 720 can swivel around the axis ("Schwenkachse" 730). In addition the Betatigungshebel 740 carries guiding bolts "Führungsbolzen" 750 that are guided in guiding holes "Führungsbohrungen" 760 situated in the base part "Grundkörper" 770. The guiding holes 760 can be used as cylinders for an air pressure actuation wherein the guiding bolts 750 situated on the trigger or handle "Betätigungshebel" 740 are used as pistons forced out of cylinders by air pressure.

Figure 7:
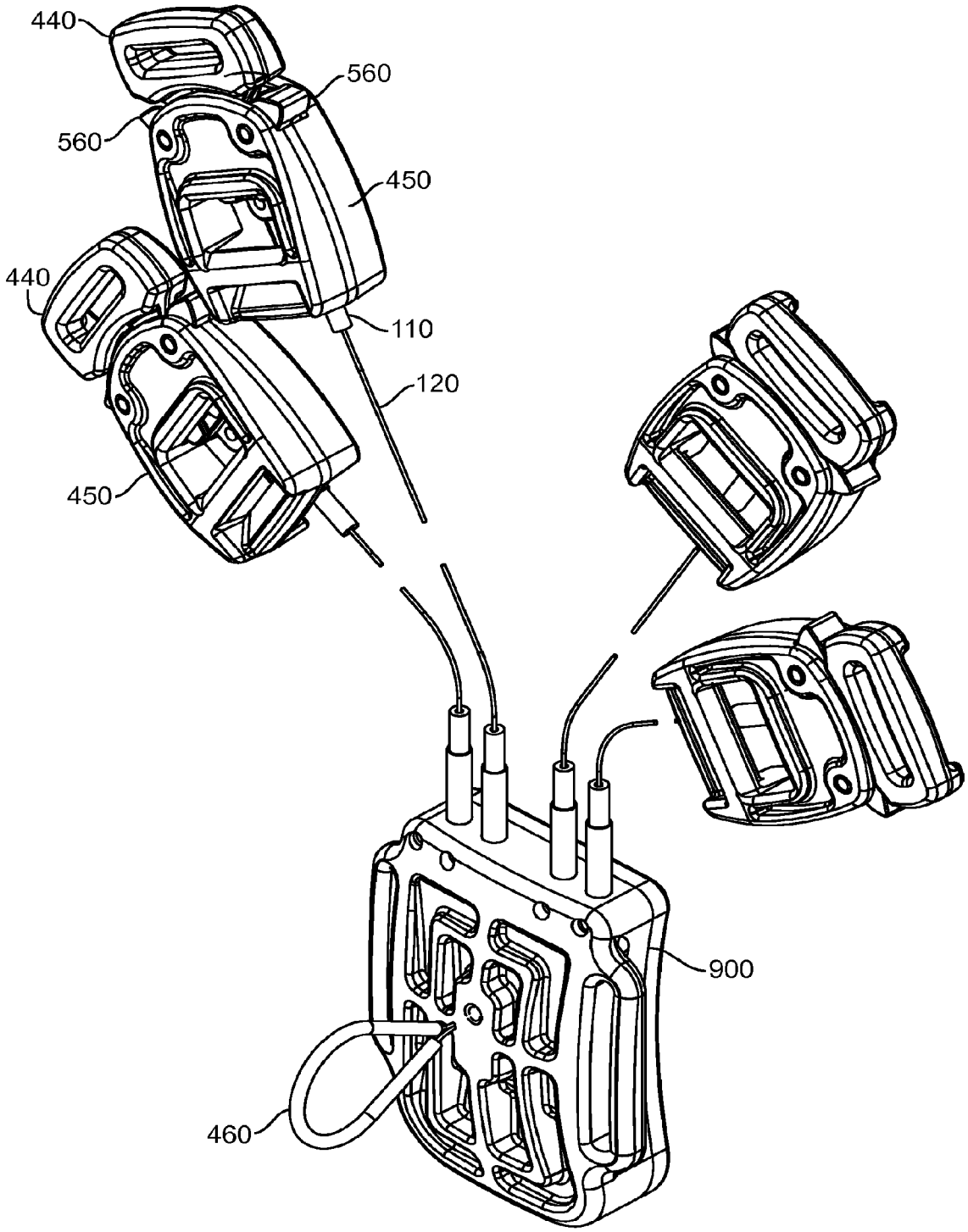
FIG. 7 and FIG. 8 illustrate embodiments where triggers and relay are combined.
Figure 8:
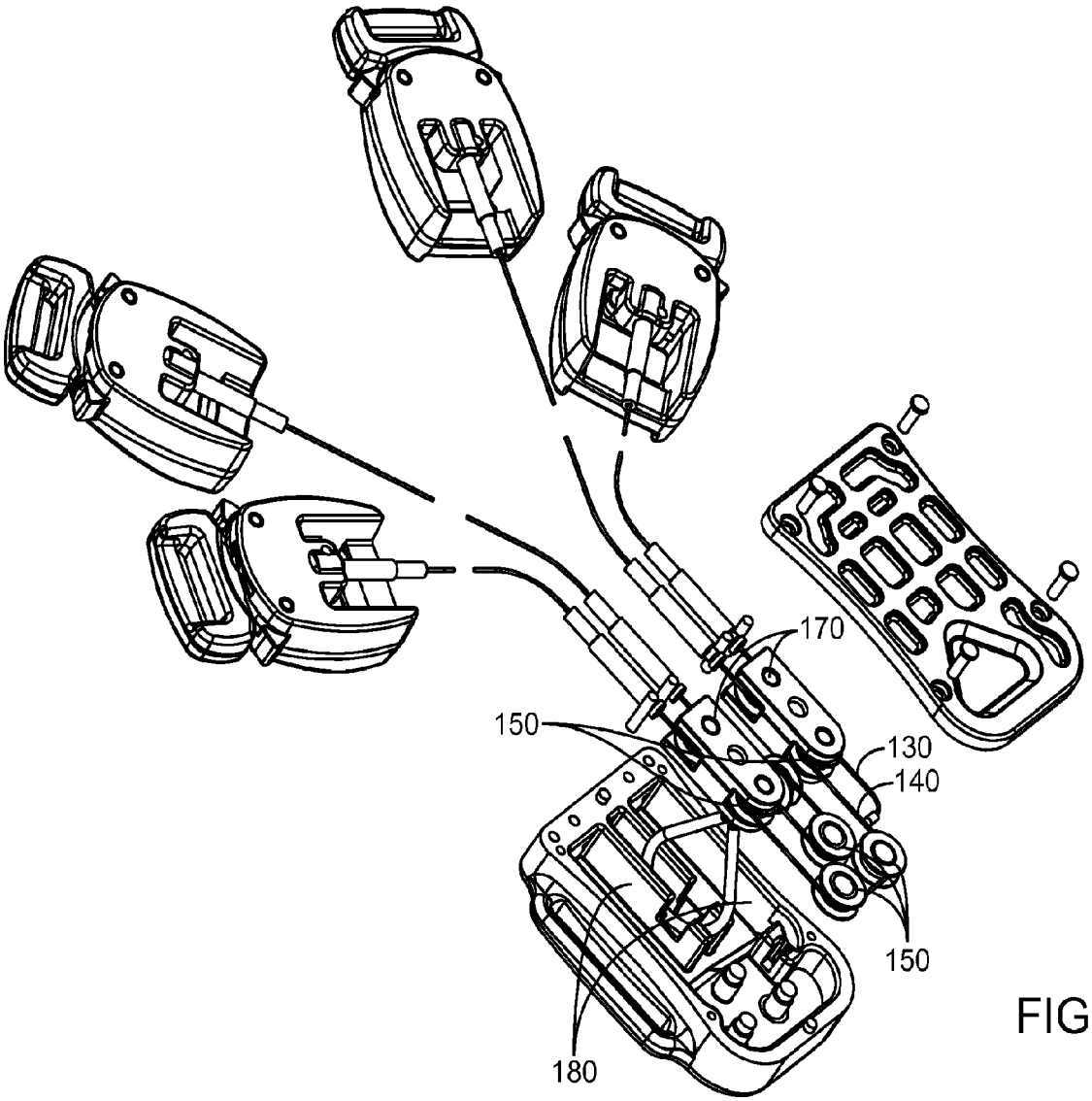

FIG. 7 and FIG. 8 show embodiments in which the trigger relay and the trigger housing are combined in one part 900. The trigger 460 is connected to the inner trigger cable 130. The end 140 of inner cable 130 is fixed to the housing of combined part 900. The inner trigger cable 130 is directed around rollers 150 as in the embodiment of FIG. 1 and FIG. 2. The structure and function of the interior of part 900 is basically the same as in trigger relay 400 shown in FIG. 1 and FIG. 2.

Figure 9:
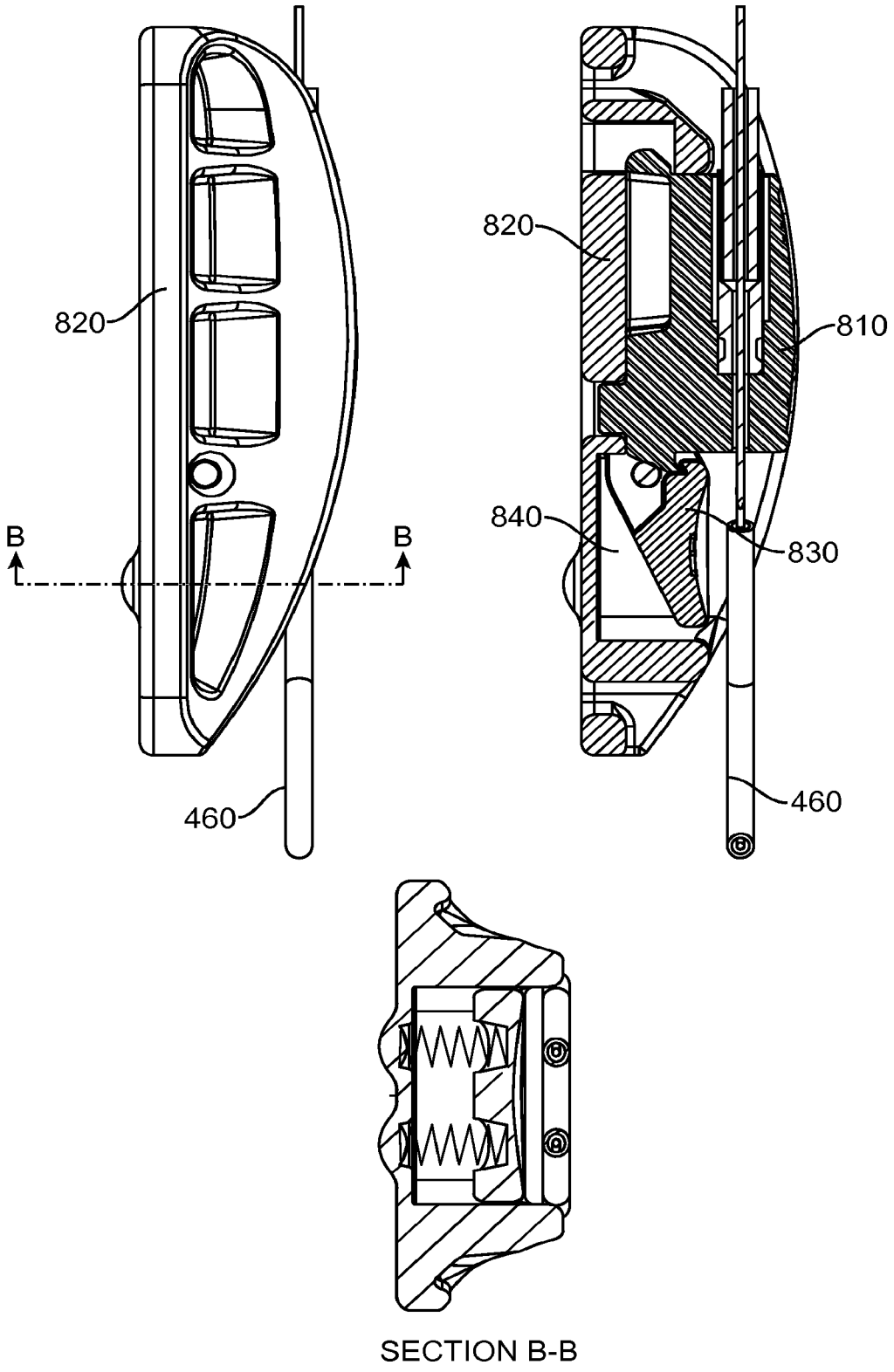
FIG. 9 illustrates embodiments having a push-button release.

Alternative embodiments for the trigger housing 461 are shown in FIG. 9. In these embodiments, the inner trigger cable 130 and its outer cable 110 are mounted to an intermediate member "Einrastteil" 810 which can be released from a base plate "Teil A" 820 by pressing the release member "Lösehebel C" 830. The release member is a lever which can be rotated around an axis 840 which is fixed to the housing "Teil A" 820. The release member 830 is prestressed by the springs "Feder" in the closed direction in which the intermediate member 810 is fixed to the base plate 820. The target of having the releasable intermediate member "Einrastteil B" 810 is that the trigger 460 can be released from the base plate "Teil A" 820 easily, for example in the ease that the trigger housing is fixed to a front part of a vest and the rest of the system is fixed to a back part of the vest.

The technology relates to attachment systems with remote triggering. In some embodiments, the systems operate with connection assembly comprising a gaseous and/or fluid pressure transmission medium; in other embodiments the connection assembly comprises an electrical signal transmission between a trigger relay and the attachment assemblies that allows the attachment assemblies to be controlled.

An example embodiment in accordance with FIG. 12 to FIG. 15 envisages pressure transmission by means of a pressure transmission medium between the trigger relay 5 and the attachment assembly 8. The pressure transmission medium can be both gaseous as well as fluid, e.g., hydraulic oil, fluids with low freezing point, air, $CO_2$. In the shown example embodiment four attachment assemblies 8 are operated via the trigger relay 5. Other odd or even number of attachment assemblies 8 can be used. In the illustrated embodiments, the attachment assemblies 8 have at least one male portion 9 and at least one female portion 10, whereby the male portion 9 can be inserted and locked in the female portion 10. In order to transmit the pressure via the pressure transmission medium from the trigger relay 5 to the individual attachment assemblies 8 (or specifically in the example embodiment shown here, to their male portions 9), the male portions 9 of the attachment assembly 8 are each connected to the trigger relay 5 via a tube 7 filled with pressure transmission medium. The tubes 7 are in parts only shown as dotted lines in the figure. This means that they can be of any length beyond the selected depiction. Continuous tubes 7 between the trigger relay 5 and the relevant attachment assembly 8 are preferred.

The structure of preferred designs of the attachment assemblies 8 in accordance with the first example embodiment (FIG. 12 to FIG. 15) and also that of other forms of embodiment operating with a pressure transmission medium are explained further below with the aid of FIG. 21 to FIG. 33.

By operating a trigger 1, the attachment assemblies 8 can be opened, preferably simultaneously, near simultaneously, or concurrently. In the first example embodiment the trigger 1 is arranged in a trigger housing 2 that is connected to the trigger relay 5 by means of a cable assembly, e.g., a Bowden cable. In the depicted embodiment trigger 1 is a loop of sheathed cable. But this is of course only one example. The trigger 1 can also be designed in different ways.

Figure 12:
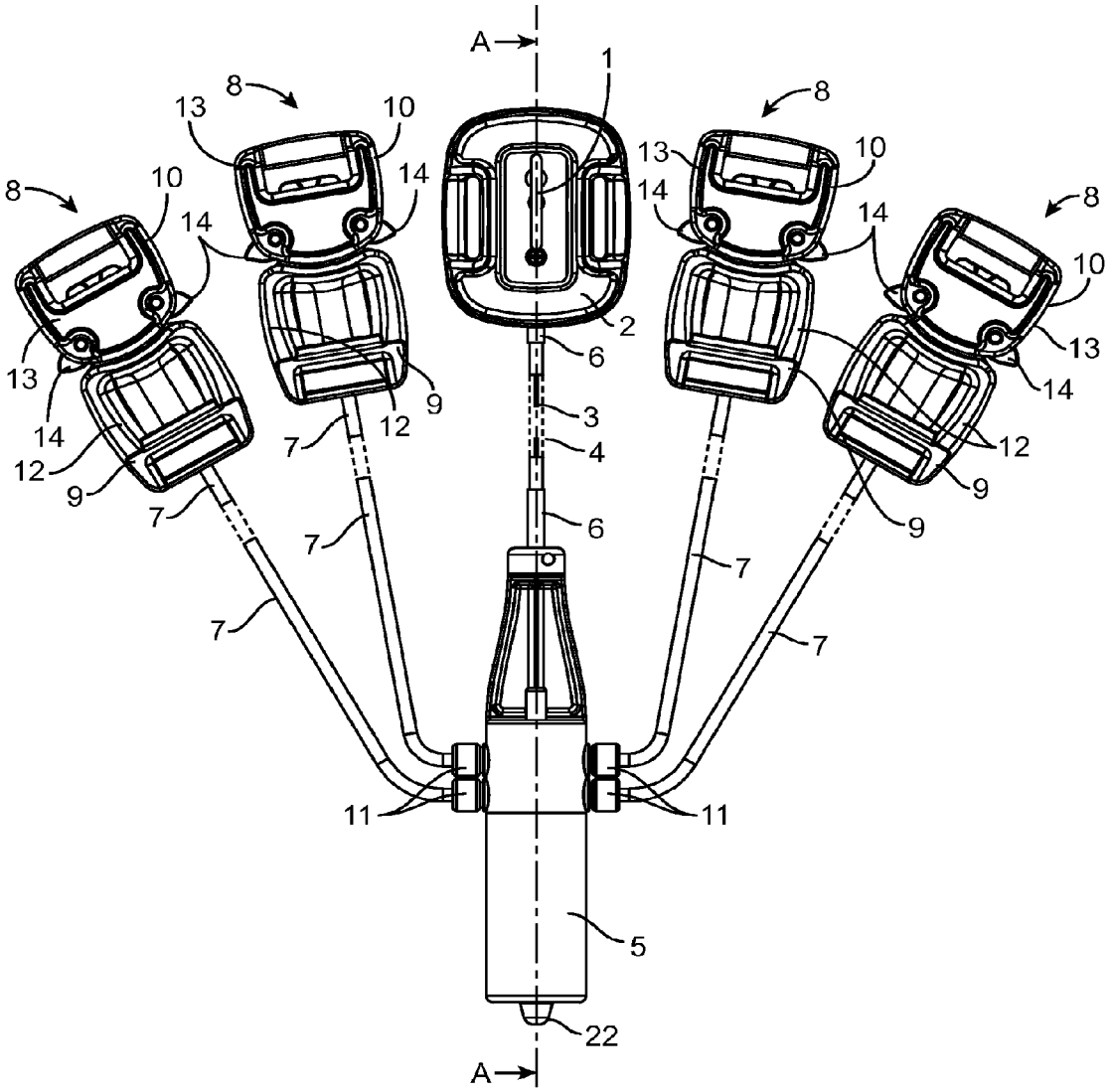
FIG. 12 to FIG. 15 illustrate embodiments according to the technology using a pressure transmission medium.
Figure 13:
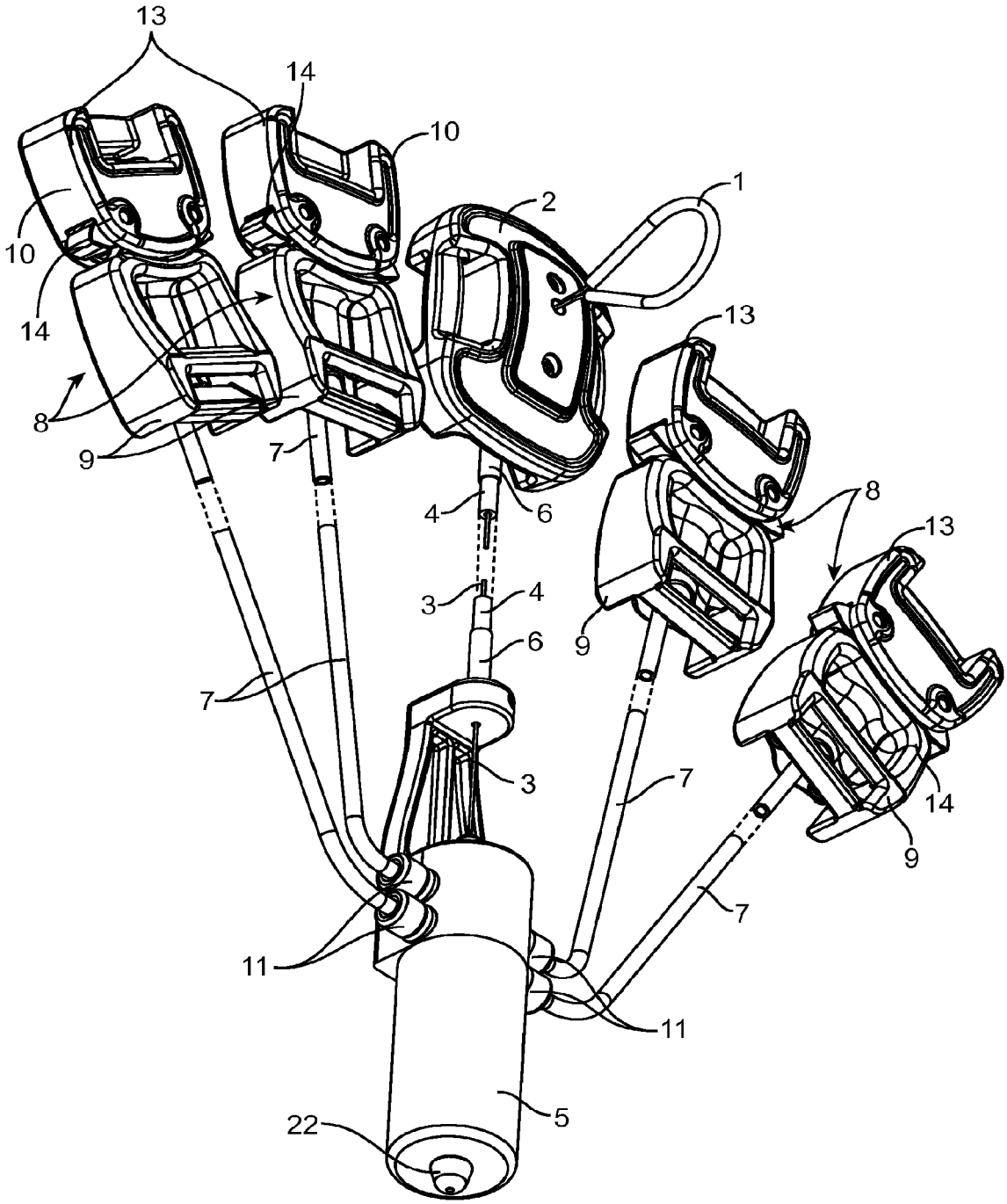
Figure 14:
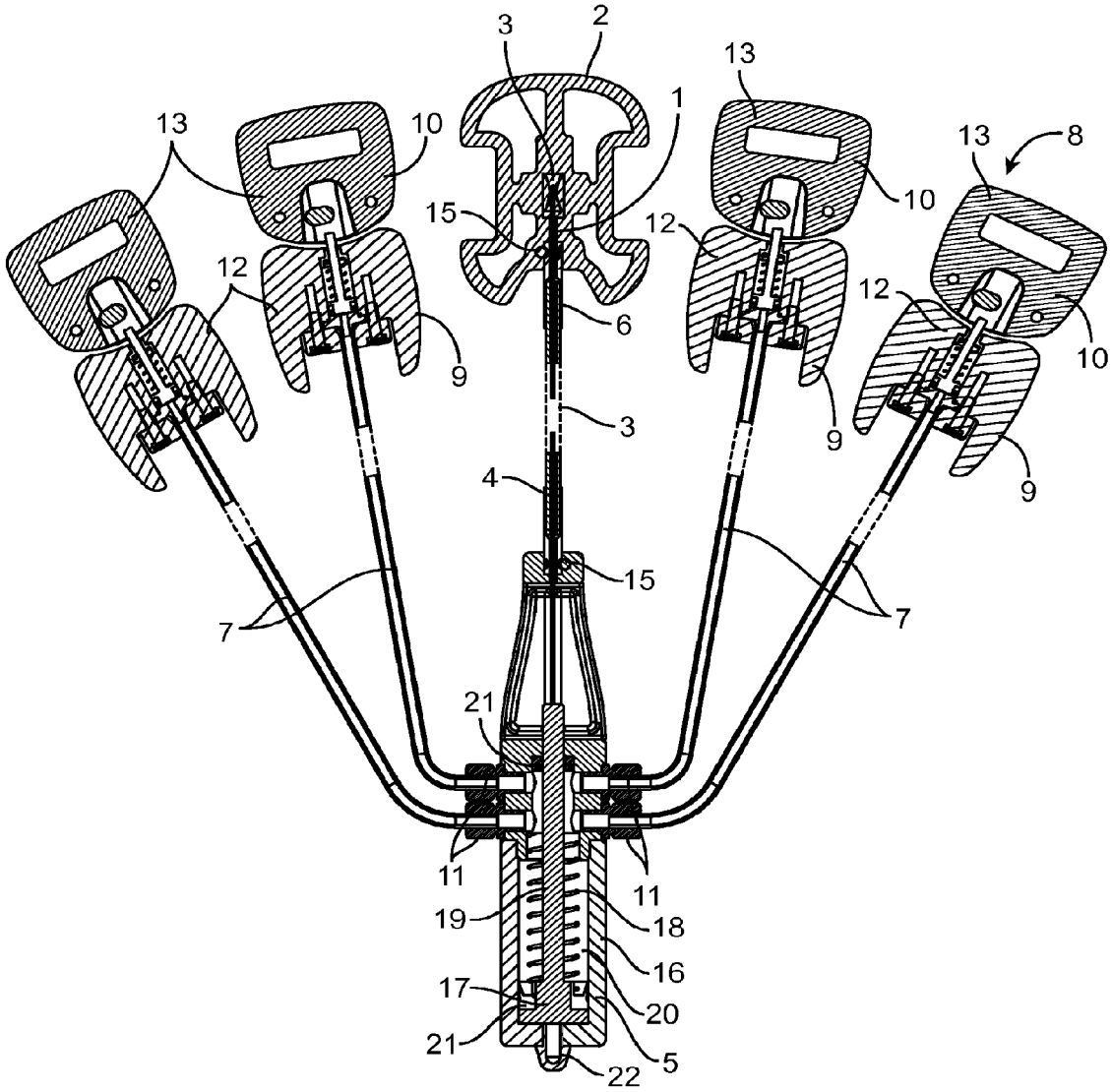
Figure 15:
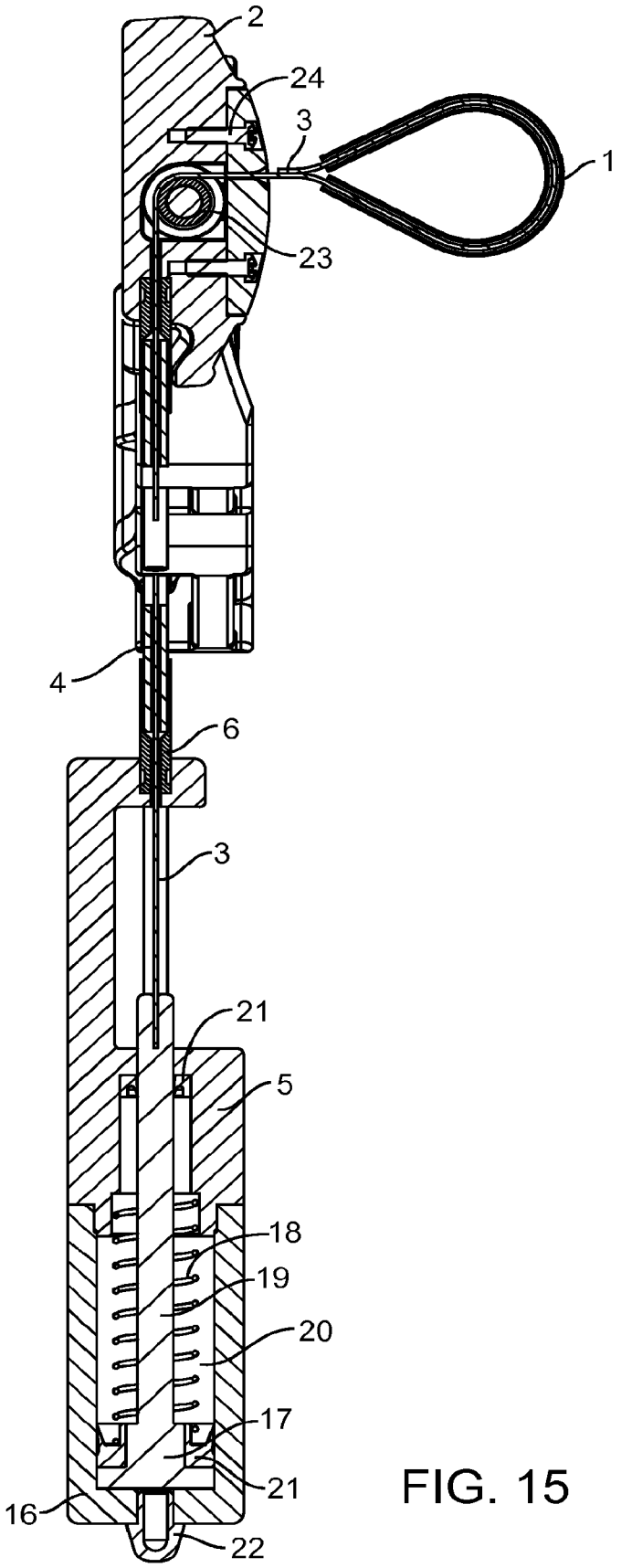

FIG. 12 shows a view from above on the first example embodiment according to the technology, FIG. 13 is a perspective view, FIG. 14 shows a section through the first example embodiment according to the technology in a plane parallel to the plane of the drawing in FIG. 12. FIG. 15 shows a cross-section through trigger housing 2 and trigger relay along the line A-A shown in FIG. 12.

The structure and mode of operation of the first example embodiment can be explained with the aid of the cross-sections in accordance with FIG. 14 and FIG. 15. Trigger 1 is connected with a piston rod 19 by means of the inner trigger cable 3. The cable 3 is turned around via roller 23 inside the trigger housing 2. The inner trigger cable 3 and the outer cable 4 which surrounds this inner trigger cable 3 form the Bowden cable which connects the trigger housing 2 with the trigger relay 5. The outer cable 4 is supported by cable shoes 6 both on the trigger housing 2 and on the trigger relay 5. To attach the cable shoes 6 to said components, securing bolts 15 are provided. The piston rod 19 example embodiment can be connected as one piece to an operating piston 17; alternative attachment variants between the operating piston 17 and piston rod 19 are known to those skilled in the art of the technology. The operating piston 17 is arranged together with the piston rod 19 in a movable manner in the operating cylinder 16. The return spring 18 can be pre-tensioned in such a way that it exerts a force on the piston 17, which force acts on the piston 17 in the direction of the cylinder vent 22. Both on the piston 17 and on the end of the operating cylinder 16 opposite to the cylinder vent 22, a seal 21 is provided that seals off the actuating chamber 20. The actuating chamber 20, like the tubes 7, can be filled with the relevant pressure transmission medium. The tubes 7 provide a connection, through which the pressure transmission medium can flow and/or transmit pressure, between the actuating chamber 20 in the operating cylinder 16 of the trigger relay 5 and the actuating chamber 30 (which can be on elements other than the male member 9) of the attachment assembly 8, which is described below in detail with the aid of FIG. 21 to FIG. 33.

By pulling on the trigger 1, the piston rod 19 and the operating piston 17 are pulled via the inner trigger cable 3, which is turned around by the roller 23 in the direction of pulling. As a result, the operating piston 17 and piston rod 19 move from the end position shown in FIG. 14 and FIG. 15 in the direction of the connection 11 of each tube 7. This reduces the volume of the actuating chamber 20 in the operating cylinder 17, which results in the pressure medium contained therein being pressed via the tubes 7 into the actuating chambers 30 of the attachment assemblies 8; which, as explained below, opens the locking device in the attachment assemblies 8 and preferably also pushes the male portion 9 out of the female portion 10, so that the male portion 9 of the relevant attachment assembly 8 is, or can be readily. removed from the corresponding female portion of the attachment assembly 8 completely. This opening process can take place concurrently on all the attachment assemblies 8 connected to the trigger relay 5. In order not to brake or inhibit the piston 17 through negative or excess pressure which occurs on the side of the operating piston 17 opposite the actuating chamber 20, the cylinder vent 22 is provided on the end of the operating cylinder 16 facing away from the connections 11. Air can flow through this into the operating cylinder 16 to the side of the operating piston turned away from the actuating chamber 20 if the operating piston 17 is moved in the direction towards the connections 11. If the piston 17 is moved in the other direction air can leave the interior of the cylinder 16 through the cylinder vent 22 too. The cylinder vent 22 can be made of any air-permeable material. It could, to name an example, be a fine grid.

Once the trigger 1 has been released the return spring 18 pushes the operating piston 17 back into the position in accordance with FIG. 14 and FIG. 15. In doing so the pressure transmission medium is sucked back out of the actuating chambers 30 of the attachment assemblies 8 via the tubes 7 into the actuating chamber 20 of the operating cylinder 16. Through the connection with the piston rod 18 on the return stroke of the operating piston 17 the trigger 1 is pulled back into its original position via the inner trigger cable 3.

Whereas in the first example embodiment in accordance with FIG. 12 to FIG. 15 the trigger housing 2 and the trigger relay 5 are connected to each other by way of a Bowden cable, and can therefore be arranged at a distance from one another, the second example embodiment according to the technology in FIG. 16 to FIG. 20 exhibits a variant in which the trigger housing 2 and the trigger relay 5 are arranged in a joint housing. This example embodiment utilizes a gaseous or fluid pressure transmission medium. Except tor the cited differences, the structure and operation of the second example embodiment according to FIG. 16 to FIG. 20 corresponds substantially with that of the first example embodiment in accordance with FIG. 12 to FIG. 15.

Figure 16:
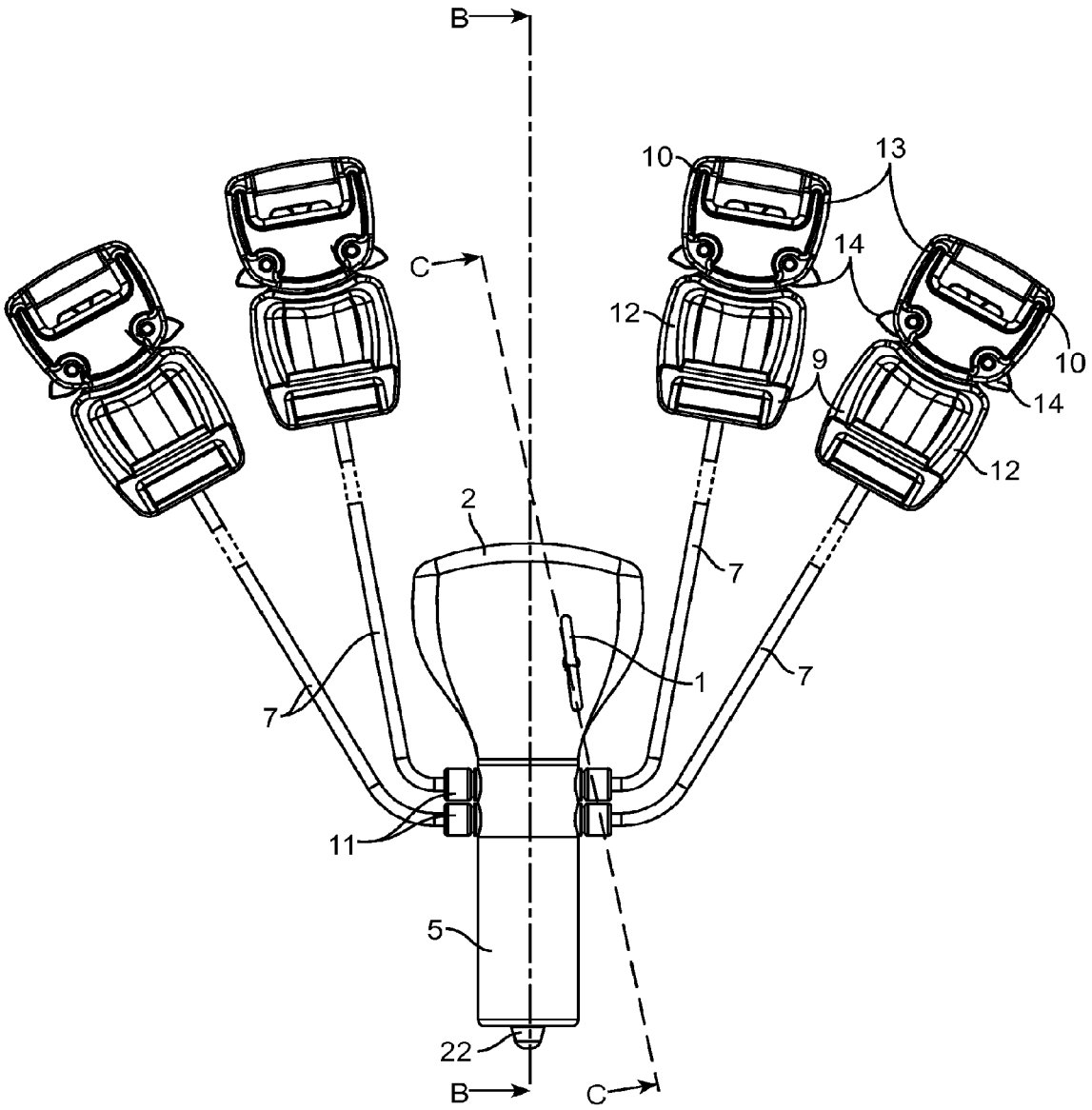
FIG. 16 to FIG. 20 illustrate embodiments according to the technology using a pressure transmission medium.

FIG. 16 shows a view from above on the second example embodiment in accordance with the technology. Here too the number of attachment assemblies 8 which can be operated from one common trigger relay 5 is only an example. As in the first example embodiment, in the case of the second example embodiment the number of attachment arrangements 8 can also be different from that shown.

Figure 17:
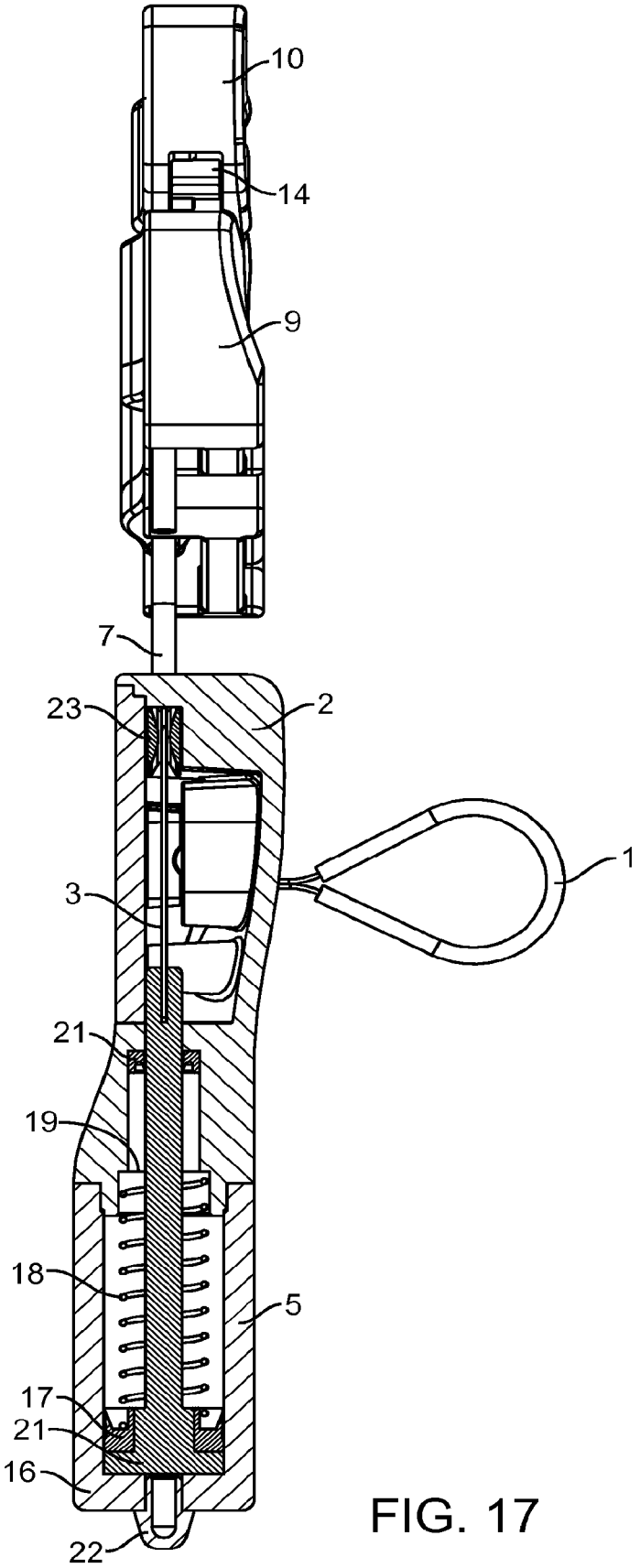
Figure 18:
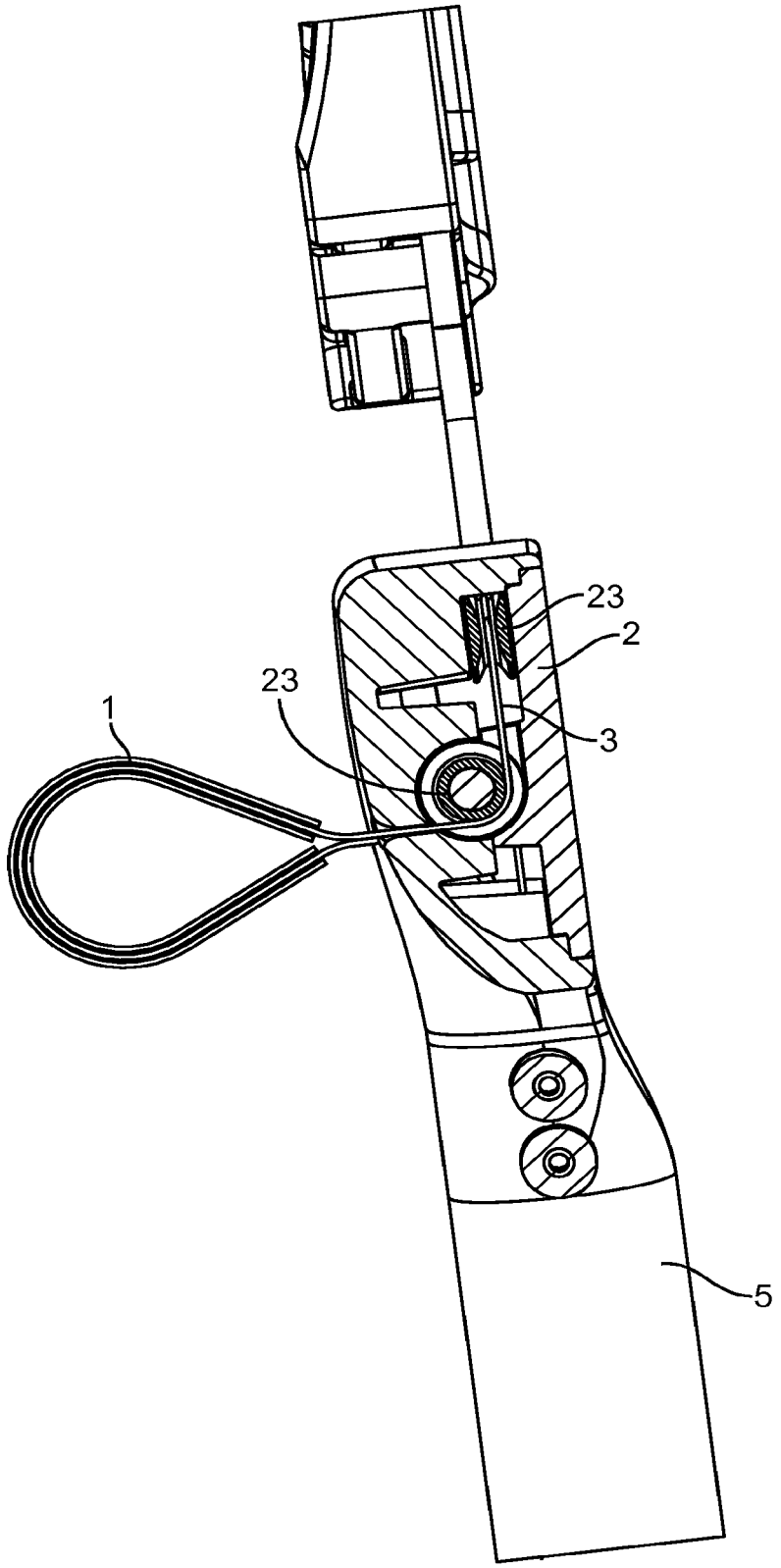
Figure 19:
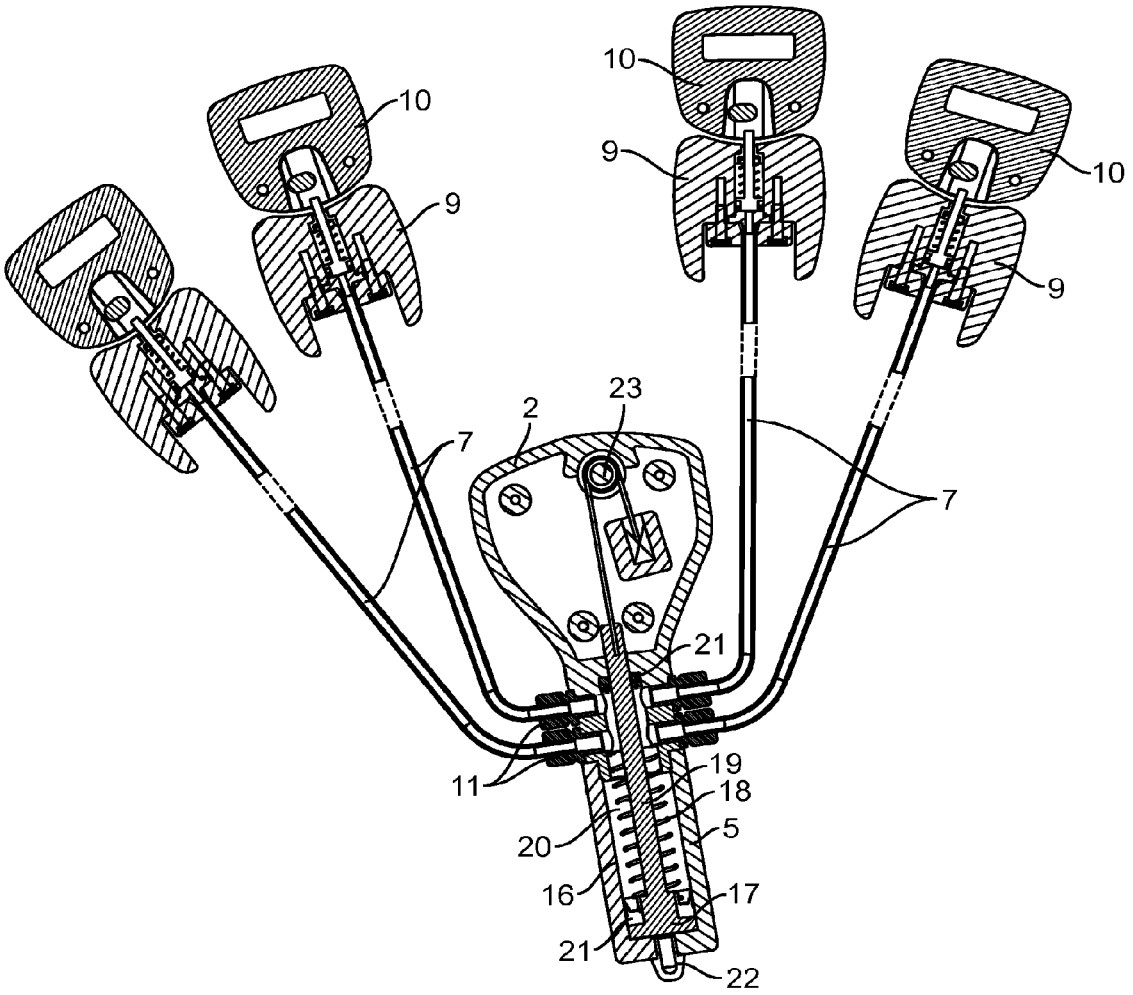
Figure 20:
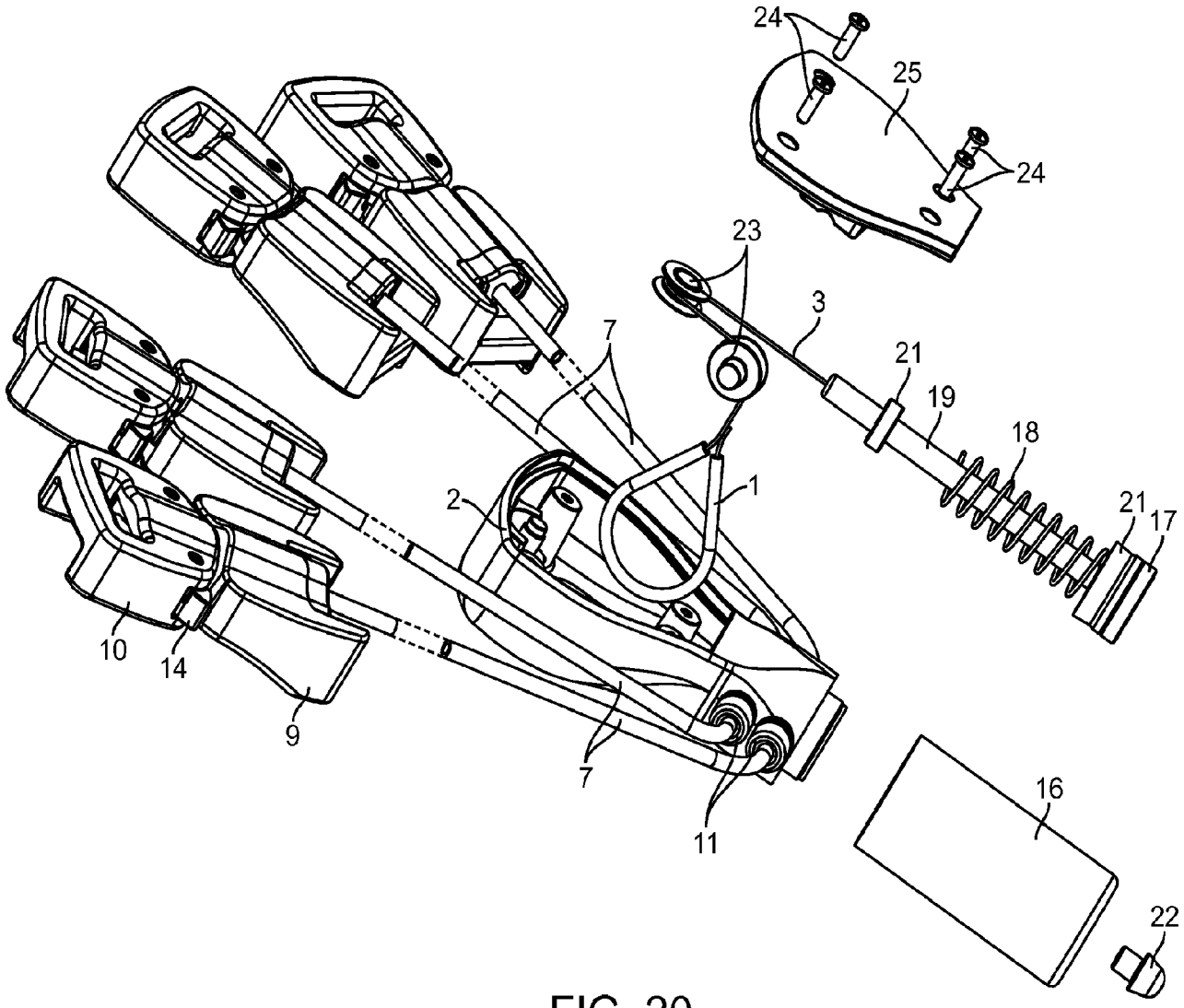

FIG. 17 shows a cross-section along line B-B in FIG. 16. FIG. 18 shows the cross-section along line C-C in FIG. 16. FIG. 19 shows a cross-section along a horizontal plane which is parallel to the plane of the drawing in FIG. 16. Compared with the first example embodiment the guiding of the inner trigger cable 3 within the common trigger and trigger relay housing 2 and 5 is a changed feature. This becomes clear by looking at FIG. 20. The inner trigger cable 3 connected with the trigger 1 is initially turned about a first roller 23 and then about a second roller 23 rotating about an orthogonal axis thereto. Connected to this the inner trigger cable 3 is, as in the first example embodiment, the piston rod 19. As the trigger housing 2 and trigger relay 5 are designed as a single piece the outer cable 4 can be dispensed with in this example embodiment. The opening process is, as described in the first example embodiment, brought about by pulling on the trigger 1 and forcing the pressure transmission medium from the actuating chamber 20 into the actuating chambers 30 of the attachment assemblies 8. As in the first example embodiment, resetting takes place via the return spring 18 in the operating cylinder 16 through releasing the trigger 1. The cylinder vent 22 also operates in the same way as in the first example embodiment. FIG. 20 shows an exploded view of individual components of the combined trigger casing and trigger relay. For the sake of completeness it is pointed out that the cover 25 in the shown example embodiment is fastened to the trigger housing 2 by means of the screws 24.

Figure 21:
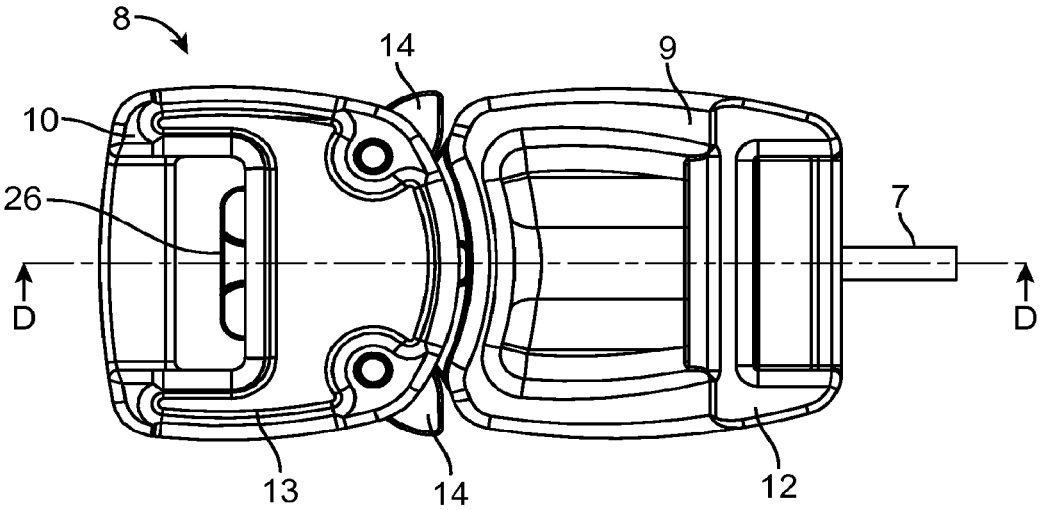
FIG. 21 to FIG. 33 illustrate embodiments of an attachment assembly using a pressure transmission medium.
Figure 22:
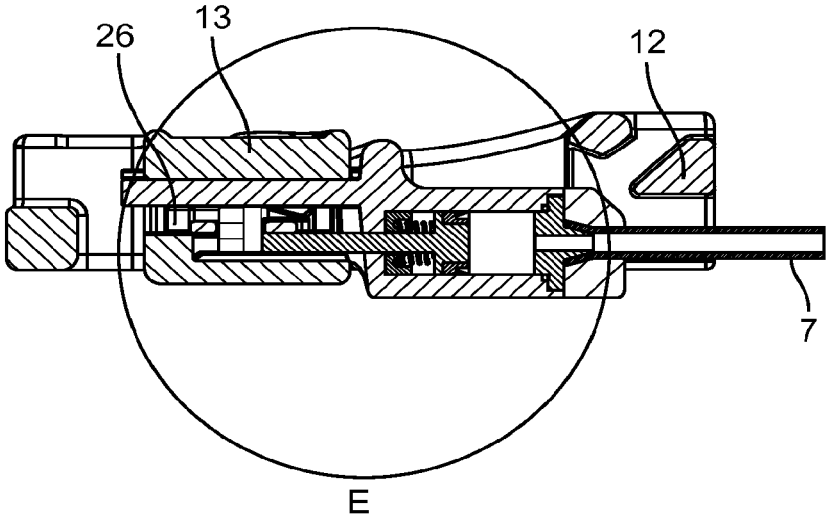
Figure 23:
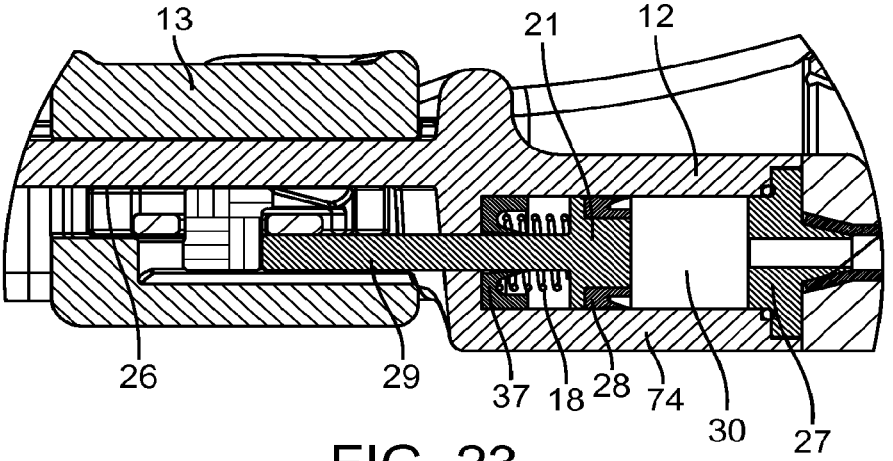
Figure 24:
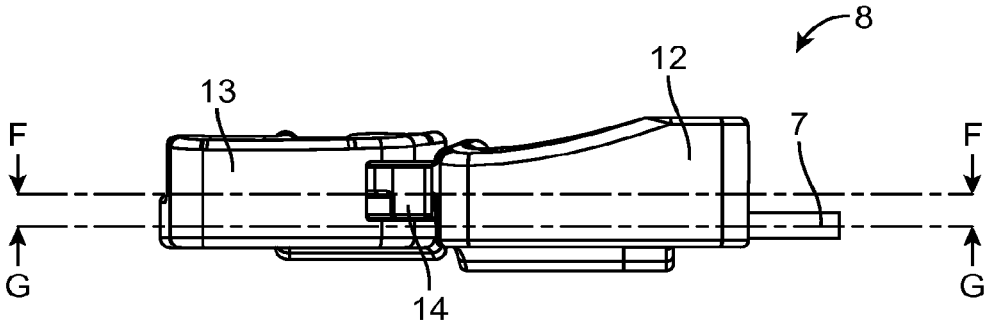
Figure 25:
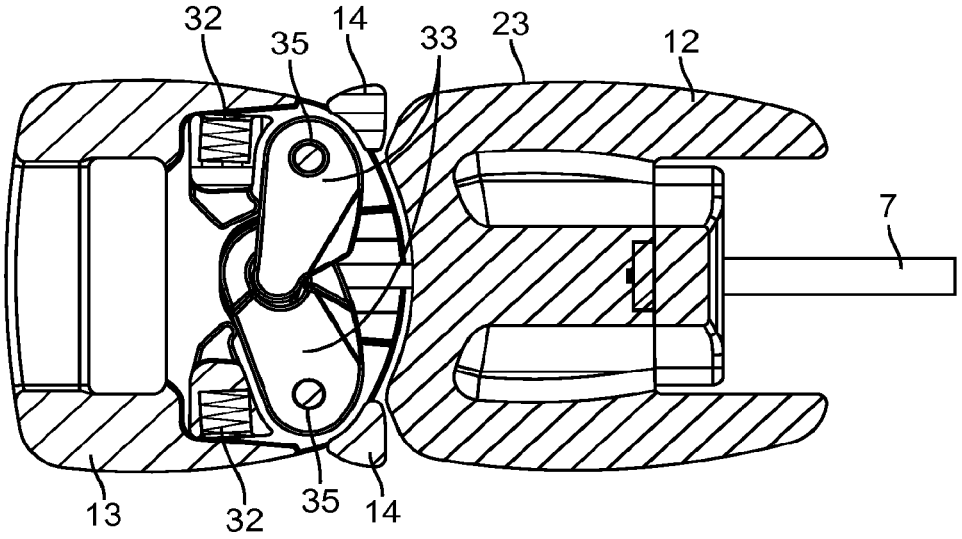
Figure 26:
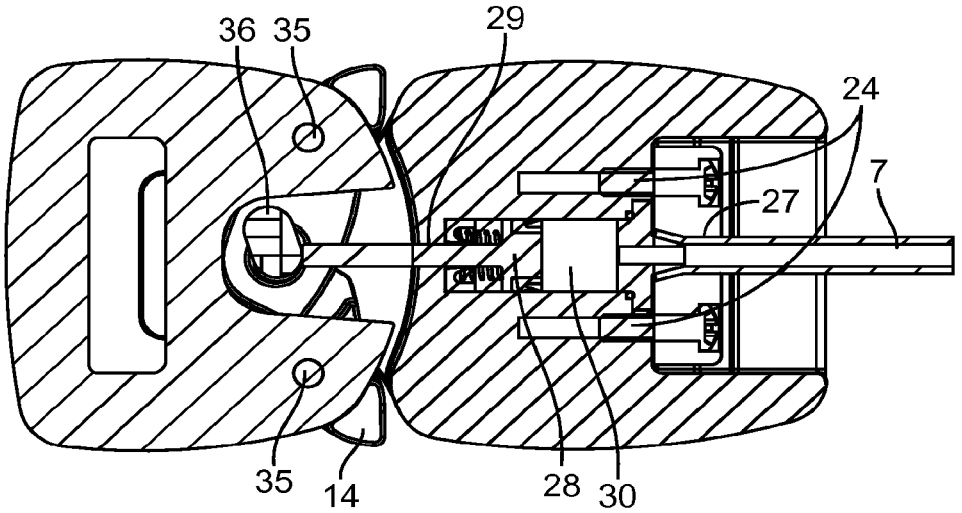
Figure 27:
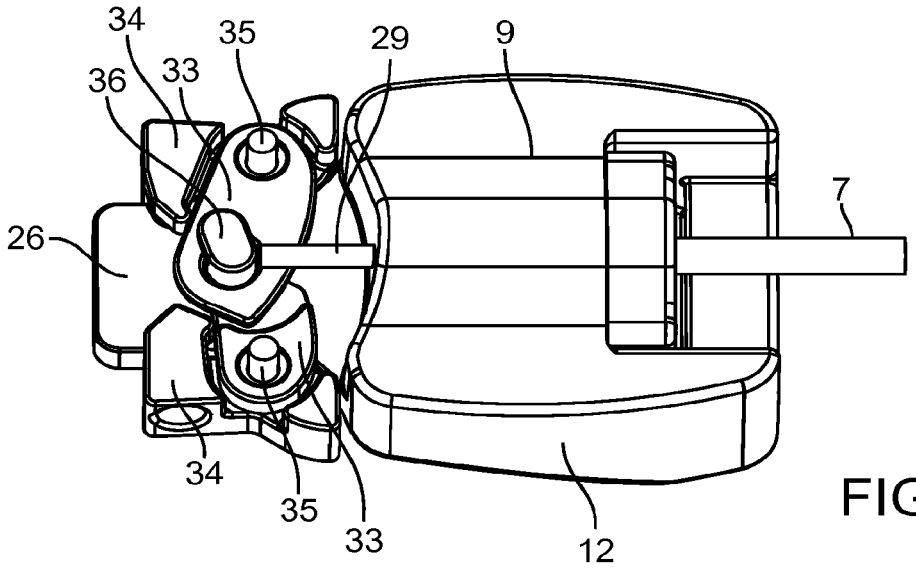
Figure 28:
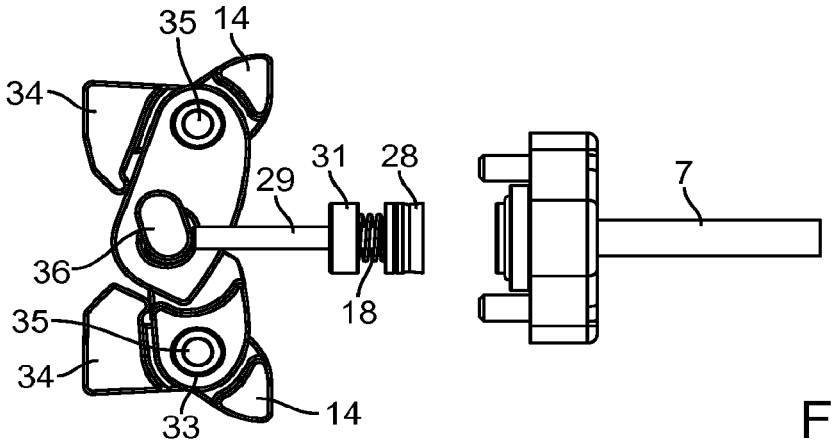
Figure 29:
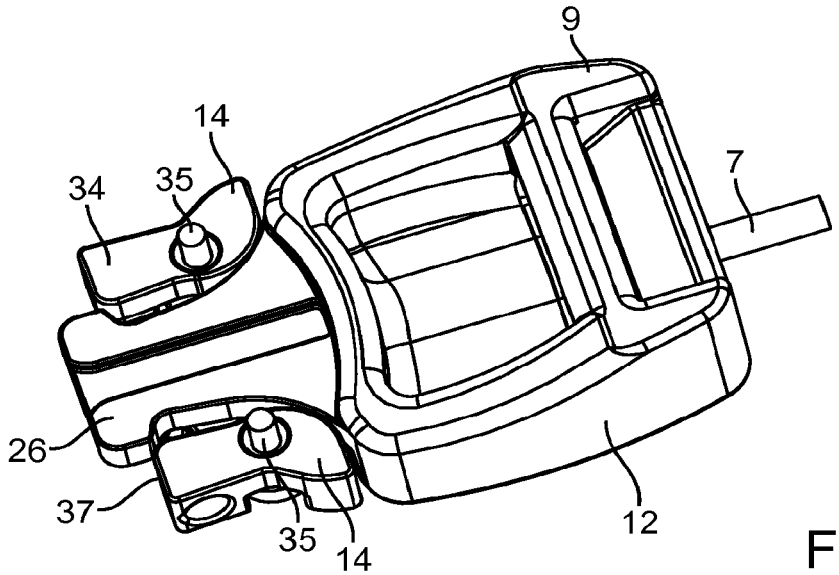
Figure 30:
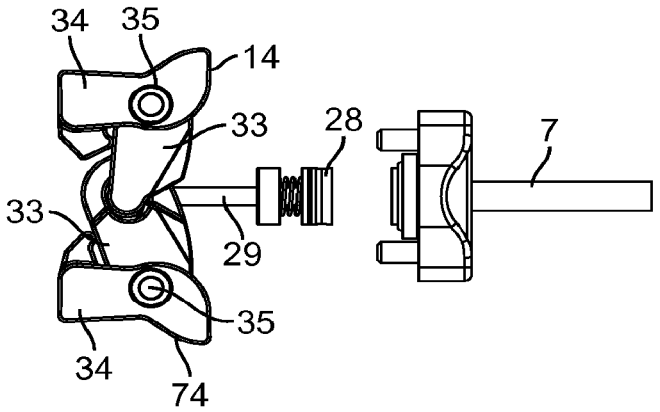
Figure 31:
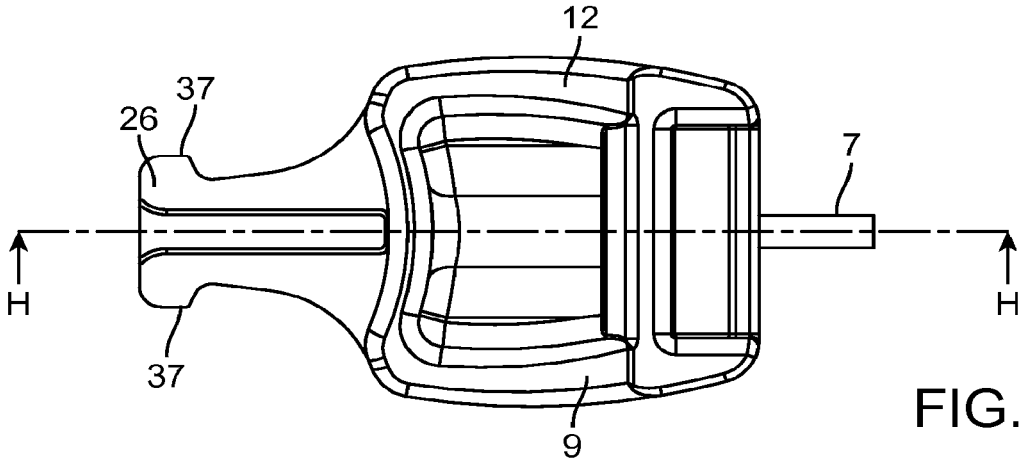
Figure 32:
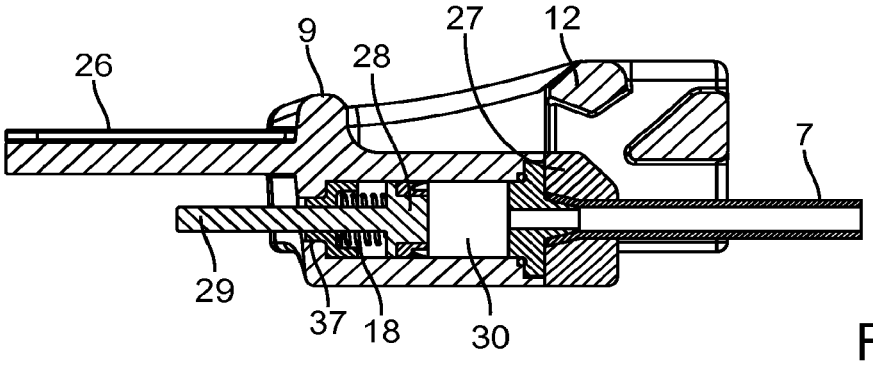
Figure 33:
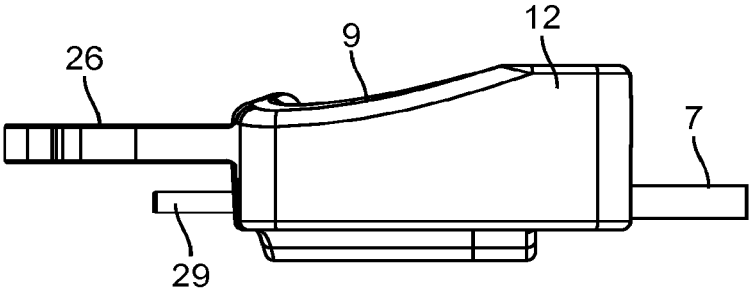

With the aid of FIG. 21 to FIG. 33 an attachment assembly will now be described. This is an example of how an attachment assembly 8 can be designed that can be used in the examples embodiments of the technology in accordance with FIG. 12 to FIG. 20 and also the example embodiments in accordance with FIG. 34 to FIG. 38. FIG. 21 shows a view from above on such an attachment assembly 8 in a position in which the male portion 9 is arranged in the locked position in the female portion 10 of the attachment assembly 8. FIG. 22 shows a cross-section along line D-D, FIG. 23 shows detail E from FIG. 22. FIG. 24 shows a side view of the attachment assembly 8. FIG. 25 shows a cross-section along line F-F in FIG. 24. FIG. 26 shows a cross-section along the line G-G in FIG. 24. FIG. 27 shows a view in which the housing 13 of the female portion 10 of the attachment assembly 8 is omitted. In FIG. 28 the housing 12 of the male portion 9 is also omitted. FIG. 29 shows a view as in FIG. 27 but from the opposite side. FIG. 30 shows a view as in FIG. 28 but from the opposite side. In FIG. 31 the male portion 9 of the attachment assembly 8 is shown separately in a top view. FIG. 32 shows the cross-section along the line H-H in FIG. 31, and in FIG. 33 a side view of the male portion 9 of the attachment assembly 8 shown in FIG. 31 is shown.

An operating principle of this attachment assembly 8 will first be explained with the aid of FIG. 21 to FIG. 23. As has already been set out, via tube 7 the pressure transmission medium, be it fluid or gaseous, is pressed into or sucked back out of the actuating chamber 30. The tube 7 is connected to the housing 12 of the male portion 9 by means of a connecting flange 27 which also ensures appropriate sealing towards the outside. In the housing 12 a cylinder is provided which is here denoted as attachment cylinder 74. This surrounds the actuating chamber 30. The attachment piston 28 is guided in a moveable manner in the attachment cylinder 74. It is sealed against the cylinder wall of the attachment cylinder 74 by means of the seal 21. At the end of the attachment piston 28 away from the actuating chamber 30 a plunger 29 is applied which can be moved together with the attachment piston 28. In the shown example embodiment, the plunger 29 and attachment piston 28 are connected to each other as one piece. But this does not necessarily have to be the case. On the side away from the actuating chamber 30, a return spring 18 acts on the attachment piston 28 in the direction of the connecting flange 27. The return spring 18 can, but does not have to be provided. The spring 18 supports the return movement of the attachment piston 28 in the direction of the connecting flange 27 if, as described above, the pressure transmission medium is sucked out of the actuating chamber 30. This support makes sense, particularly in the case of gaseous pressure transmission media. In the shown example embodiment the return spring 18 is supported on the side turned away from the attachment piston 28 on an air-permeable seal 31 that serves to impede the penetration of dirt.

As can be seen particularly from the cross-section in accordance with FIG. 26, the plunger 29, which is moved by attachment piston 28, acts on a coupling piece 36 which connects the inner levers 33 to each other in a pivoting manner. When pressure transmission medium is forced into the actuating chamber 30 the piston 28 is moved in the direction of the air-permeable seal 31, whereby the plunger 29 is also moved in the corresponding direction to the coupling piece 36. Through the plunger 29 pressing on the coupling piece 36 the first levers 33 are pivoted about axes 35. With this movement the second levers 34 also undergo a corresponding pivoting movement whereby the collars 37 of the T-shaped front end 36 of the male portion 9 are released. This open position is shown in FIG. 29. In this position of the second levers 34, the front end of the male portion 9 can be pulled out of the housing 13 of the female portion 10. Although the plunger 29 is pulled together with the male portion 9, its path in the opening movement is preferably so great that the second levers 34 are only then, triggered by the return springs 32 supported on the housing 13 of the female portion 10, moved back into the locking position when the front end 26 of the male portion 9 has been pulled out sufficiently far from the housing 13 of the female portion 10. Preferably, the opening movement of the plunger 29 is sufficiently great that the male portion 9 is pushed so far out of the housing 13 of the female portion 10 by this movement that the second levers 34 can no longer engage on the collars 37 of the T-shaped front end 26, or, to put it in general terms the attachment mechanism is no longer locked in place. The first and second levers 33 and 34 are reset via the return springs 32 within the housing 13 of the female portion 10. Returning of the plunger 29 in the direction of the connecting flange 27 takes place within the housing 12 of the male portion 9 through sucking the pressure transmission medium from the actuating chamber 30, in some embodiments supported by the return spring 18.

In addition to this form of remote triggering it is also possible to open an individual attachment assembly 8 by hand without the trigger 1 having to be pulled. If such opening of an individual attachment assembly is to be undertaken, the exposed ends 14 of the second levers 34 are pressed manually. This pivots the second levers 34 about axes 35 which in turn releases the front end 26 of the male portion 9 whereby the male portion 9 and its front end 26 can be pulled out of the housing 13 of the female portion 10. For the sake of completeness it is pointed out that this manual opening procedure in the specifically shown example embodiment is only possible if at the same time through appropriate pressure on the exposed ends 14 both second levers 34 are pivoted sufficiently far about axes 35. If only one exposed end 14 is pressed, the other second lever 34 remains in the locked position on the corresponding collar 37 of the front end 26 of the male portion 9 so that it cannot be pulled out of the housing 13 of the female portion 10. For the sake of completeness it is pointed out that in these embodiments of an attachment assembly, in divergence from the shown example embodiment, the first and second levers 33 and 34 can be designed in pairs in one piece. In this case during manual operation pressing just one exposed end 14 is sufficient to open the closure completely.

In the shown example embodiment in accordance with FIG. 21 to FIG. 33 as well as in the electrical variants described further below, the attachment cylinders 74 and the plunger 29 arranged moveably therein are attached to or arranged on the male portion 9 of the attachment assembly 9. The housing 13 of the female portion 10 on the other hand holds the operating assembly composed of levers 33, 34 and the coupling piece 36. This form of embodiment is of course only one example in the case of all the shown variants. The entire triggering mechanism elsewhere can be applied or arranged elsewhere, e.g. only on the female portion 9 or only on the male portion 9.

FIG. 34 to FIG. 38 show further alternative embodiments of a remote triggering system according to the technology and utilizing a pressure transmission medium. This variant is primarily intended for gaseous pressure transmission media. Whereas in the first two example embodiments in accordance with FIG. 12 to FIG. 20 the pressure in the pressure transmission medium is provided by the tensile force on the trigger 1 for the opening procedure, in the example embodiment according to FIG. 34 to FIG. 38 the pressure is provided by a pressurized cartridge 40 filled with pressurized gas. In this example embodiment, pulling on the trigger 1 starts the pressure transmission process described in more detail below. For the sake of completeness it is pointed out that in FIG. 34 to FIG. 38 only the tubes 7, but not the attachment assemblies attached thereto are shown. However, these can be as in the previously described forms of embodiment and do not therefore need to be shown separately again.

In the example embodiment according to FIG. 34 to FIG. 38 too, the trigger housing 2 and trigger relay 5 are in one piece. Here too, the opening procedure is started by pulling the trigger 1.

Figure 35:
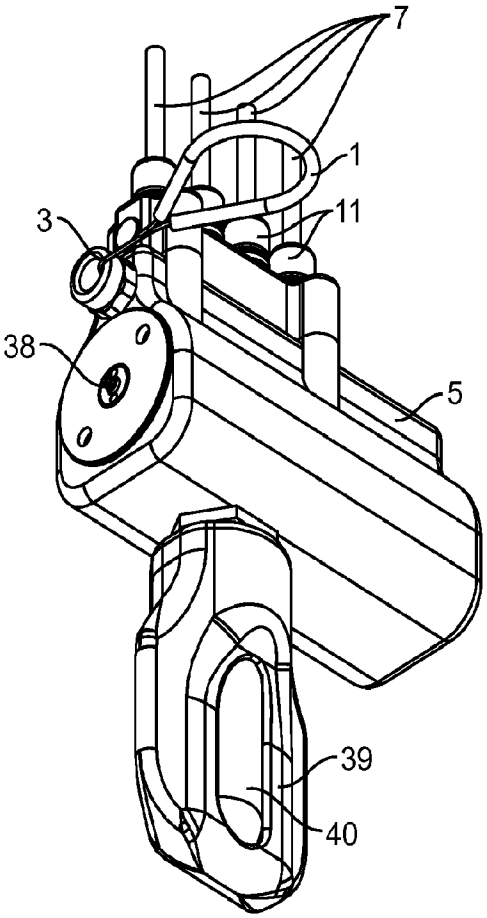
FIG. 34 to FIG. 38 illustrate embodiments according to the technology using a pressure transmission medium.
Figure 34:
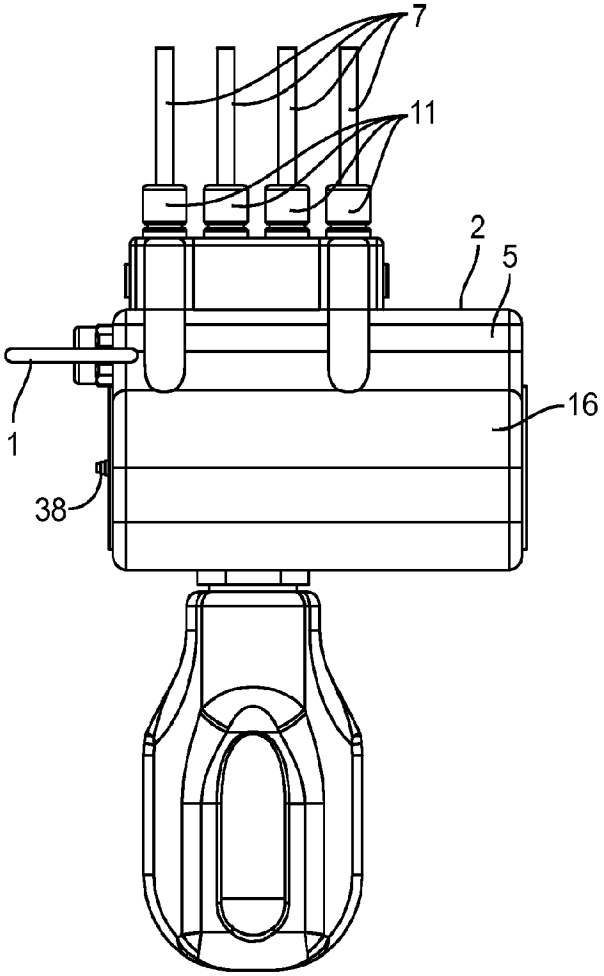
Figure 37:
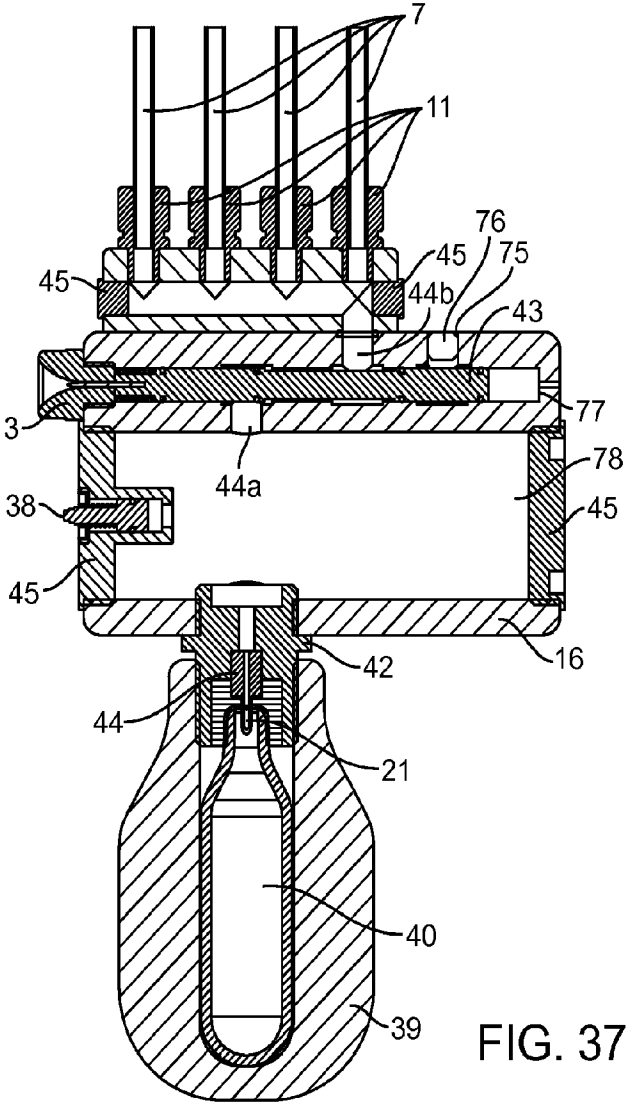
Figure 36:
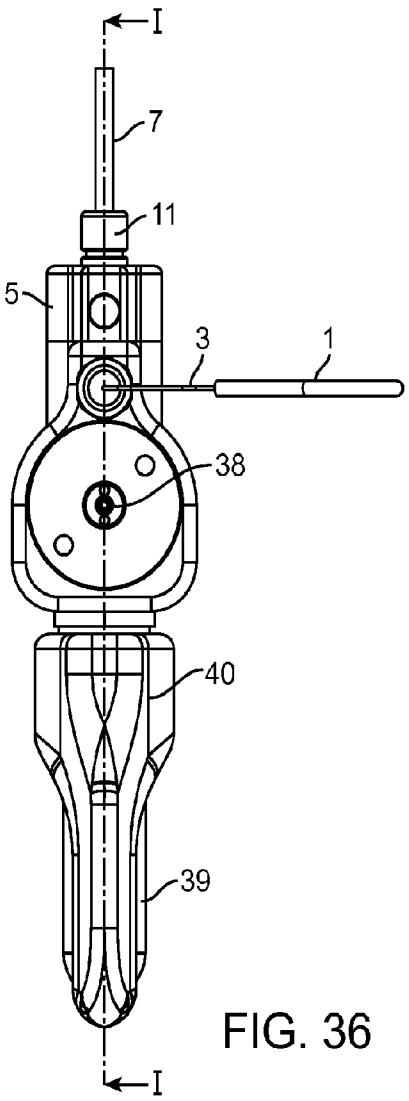
Figure 38:
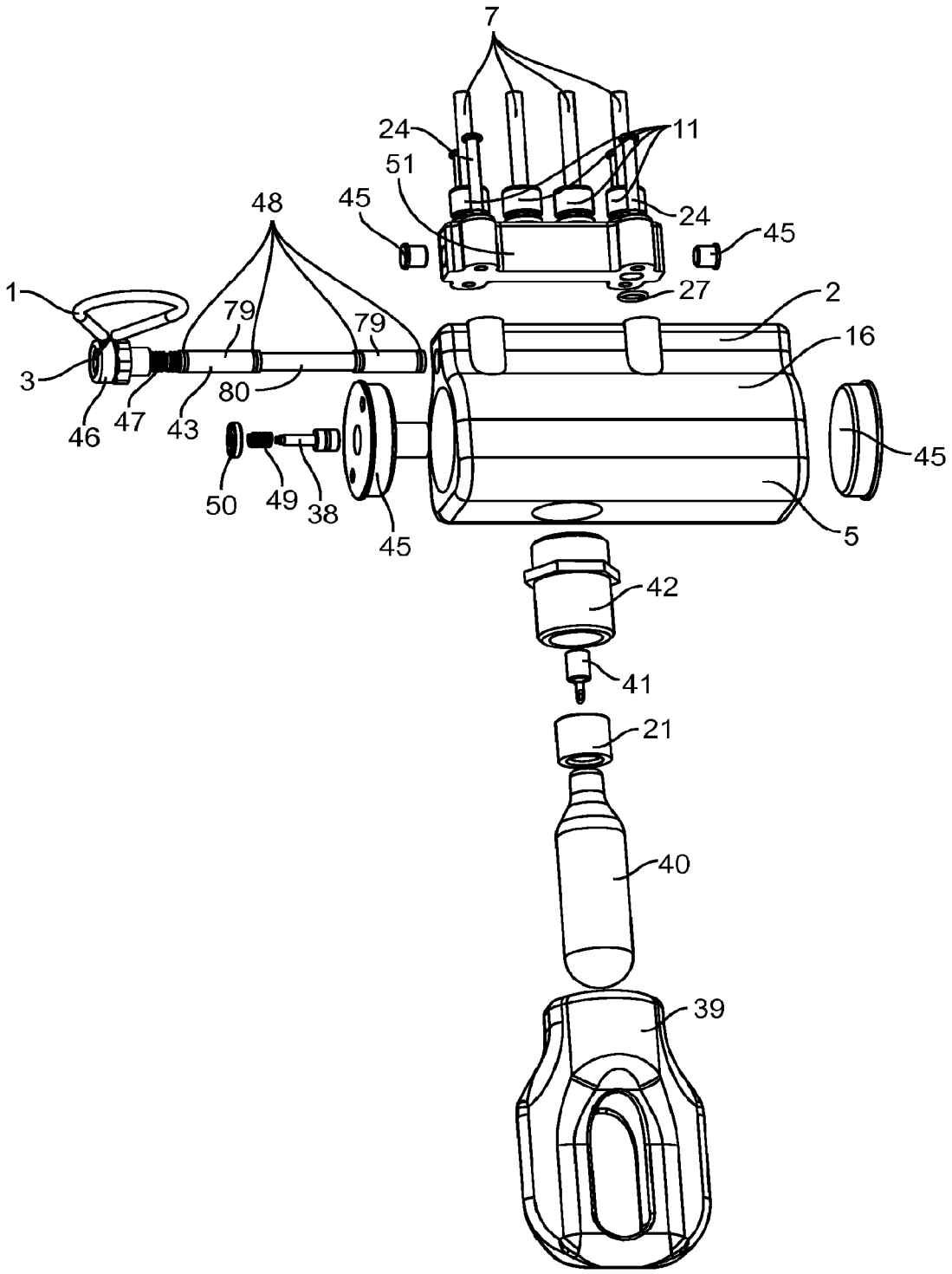

FIG. 34 shows a side view, FIG. 35 shows a perspective view and FIG. 36 shows a side view turned about 90° of a one-piece trigger housing and trigger relay. FIG. 37 shows a cross-section along line II in FIG. 36. FIG. 38 shows an exploded view of components.

The operation of this example embodiment is explained in particular with reference to FIG. 37 and FIG. 38. As has already been explained, the pressure in the gaseous pressure transmission medium is provided by way of a cartridge 40. This is arranged in a cartridge holder 39. By means of a hollow needle 41 the pressurized cartridge 40 can be pierced after being placed in the cartridge holder 39 and attachment of the cartridge holder 39 on the connection nipple 42. The gaseous pressure medium flows through the hollow needle 41 out of the pierced pressurized cartridge 40 and into the pressure accumulator volume 78. This pressure accumulator volume 78 is under pressure as long as an appropriate pressure is being supplied by the pressurized cartridge 40. Once the pressure supply has been exhausted the pressurized cartridge 40 must be replaced. To monitor whether there is still sufficient pressure in the pressure accumulator volume 78 a pressure indicator 38 is provided in the shown example embodiment. At its end facing the pressure accumulator volume 78 this is acted upon by the pressure medium in the pressure accumulator volume 78. A corresponding counter-force is provided by the pressure indicator spring 49, which is supported on the securing nut 50. The spring constant of the pressure indictor spring 49 is preferably selected so that there is sufficient pressure in the pressure accumulator volume 78 if the pressure indicator 38 is still projecting out of the closing cover 45 in which it is moveably arranged. On the opposite side the pressure accumulator volume 78 in this example embodiment is closed off by another closing cover 45.

To start the opening procedure the trigger 1 is pulled in this example embodiment. The trigger 1 is connected via the inner trigger cable 3 to a slide 43. The slide 43 connects overflow openings 44*a* to 44*b* and release of the slide 43 to allow gas release via a connection between the overflow opening 44*b* and venting opening 75. For this the slide 43 has three areas of different diameter. The edge areas 79 have a larger diameter. The central area 80 has a smaller diameter. The slide 43 is arranged in a moveable manner in a corresponding preferably cylindrical recess in the trigger relay 5 or trigger housing 2. The areas 79 are sealed off from the central area 80 by slide seals 48. In the position shown in FIG. 37 flow through is via the remaining gap between the central area 80 and the wall of the cylindrical recess in the trigger housing 2. In the position in accordance with FIG. 37 this gap forms a connection between the overflow openings 44*a* and 44*b* so that pressure transmission or overflow of the pressure transmission medium from the pressure accumulator volume 78 into the tubes 7 is possible. As has been described, this position is reached by pulling on the trigger 1 sufficiently strongly. To reach this position, through pulling on the trigger 1, the slide spring 47 is compressed. This is then supported on the one hand on the adjacent area 79 of the slide 43 and on the other hand on the cable run nipple 46. As long as the trigger 1 is kept pulled the overflow opening 44*a* remains in connection with overflow opening 44*b* allowing through flow and pressure transmission. In this position the pressure is transmitted from the pressure accumulator volume 78 to the actuating chambers 30 of the attachment assemblies 8 so that the latter are opened. If the trigger 1 is now released the slide spring 47 moves the slide 43 back into a closed position. In this position the overflow openings 44*a* and 44*b* are no longer connected to each other. The pressure accumulator 78 is closed in this position. The central area 80 of the slide 43 now forms a connection for the pressure transmission medium to flow through between the overflow opening 44*b* and the venting opening 75 so that the gaseous pressure transmission medium can escape from the actuating chamber 30 via the tubes 7 and through the venting opening 75. In the shown example embodiment a closure 76 is provided in the venting opening 75. This discourages the penetration of dirt. It can be gas-permeable. Alternatively it is possible to just keep the closure 76 wedged in the venting opening 75 so that during venting it can be pushed out of the venting opening 75. The pressure equalization opening 77 allows the slide 43 to be moved in its cylindrical recess without undesirable under- or over-pressure forming in the cylindrical recess at the end of the slide 43 facing away from the trigger 1. In the shown variant the pneumatic distributor 51 that forms the connection between the overflow opening 44*b* and the tubes 7 is attached to the trigger housing 2 with screws 24. However, this is of course only one of many attachment possibilities. Detachable fastening of the distributor 51, like the provision of a removable closing cover 45 in the distributor 51, has the advantage of facilitating cleaning measures. Attachment can also be as one piece on the trigger housing 2.

Whereas in the examples embodiments discussed so far do not only utilize pressure transmission medium but incorporate mechanical connection too, the examples of embodiment according to FIG. 39 to FIG. 53 show an attachment system with remote triggering in which the connection between the trigger relay 5 and the attachment assembly/assemblies 8 is electrical, and opening of the attachment assembly/assemblies 8 can be controlled both electrically and electromagnetically, and carried out electro-mechanically. In the shown embodiments, the trigger housing 2 and trigger relay 5 are in the form of a one-piece housing. However, this does not have to be so. With the electrical and electromagnetic variants it is also possible to arrange the trigger housing 2 and trigger relay 5 separately in their own housings which can then be connected to each other, for example by means of the Bowden cable, shown in the first example embodiment according to FIG. 12 to FIG. 15, comprising an inner rigger cable 3 and an outer cable 4.

Figure 39:
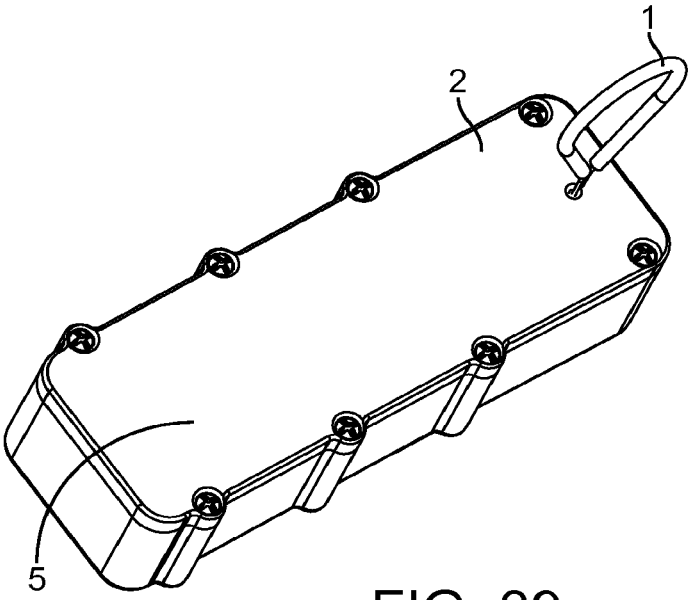
FIG. 39 to FIG. 45—depict embodiments according to the technology on the basis of electrical signal transmission.
Figure 40:
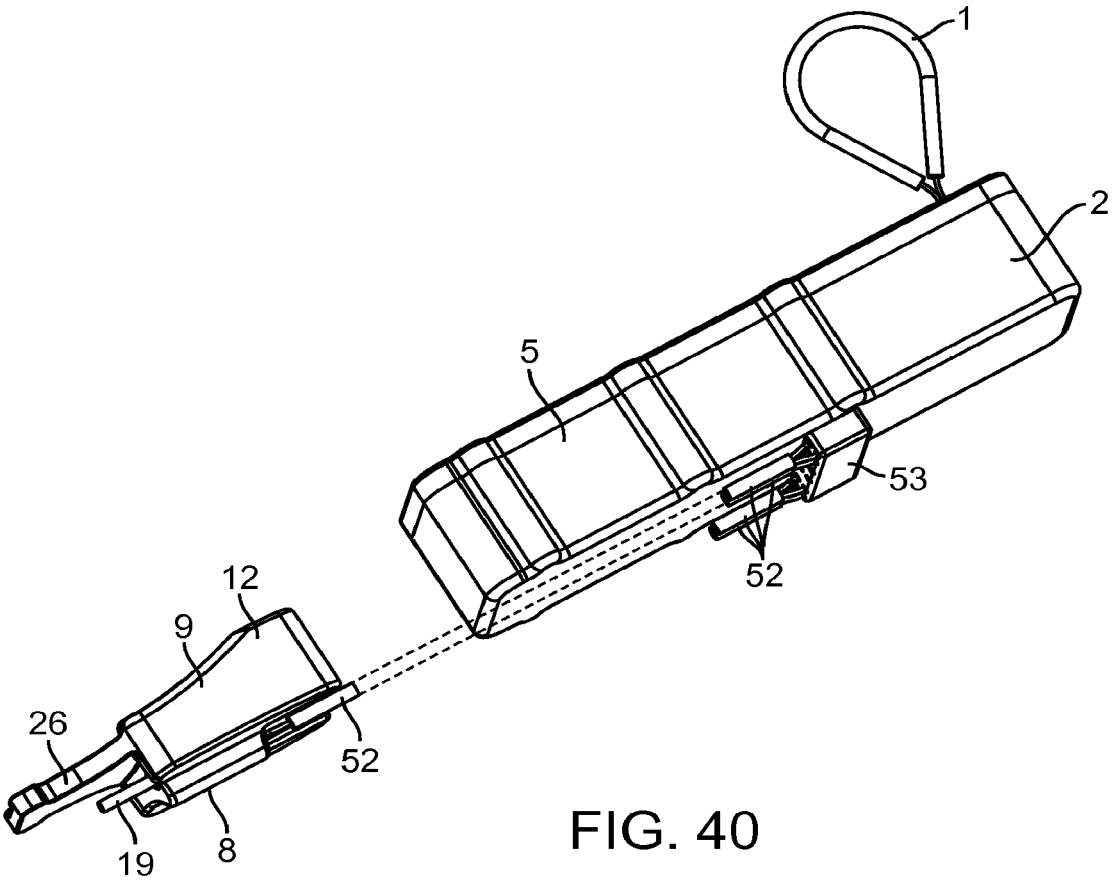

FIG. 39 shows a perspective view of the upper side of the housing. FIG. 40 shows a view from below, whereby, for example, a male portion 9 of the attachment assembly 8 is also shown. The electrical connection between the male portion 9 and the trigger relay 5 is via the electrical connection cable 52. The length of this cable, like the length of the tubes 7 in the examples of embodiment described above, can be matched to the relevant positions. In FIG. 40 the connection is shown in dotted lines. In the case of the electrical embodiment variants, different numbers of attachment assemblies 8 can be attached to a single trigger relay. FIG. 40 only shows one male portion 9 of such an attachment assembly 8. However almost any other number can be used. In the shown example embodiment the electrical distributor 53 is provided to connect the electrical connection cable 52 to the trigger relay 5.

Figure 41:
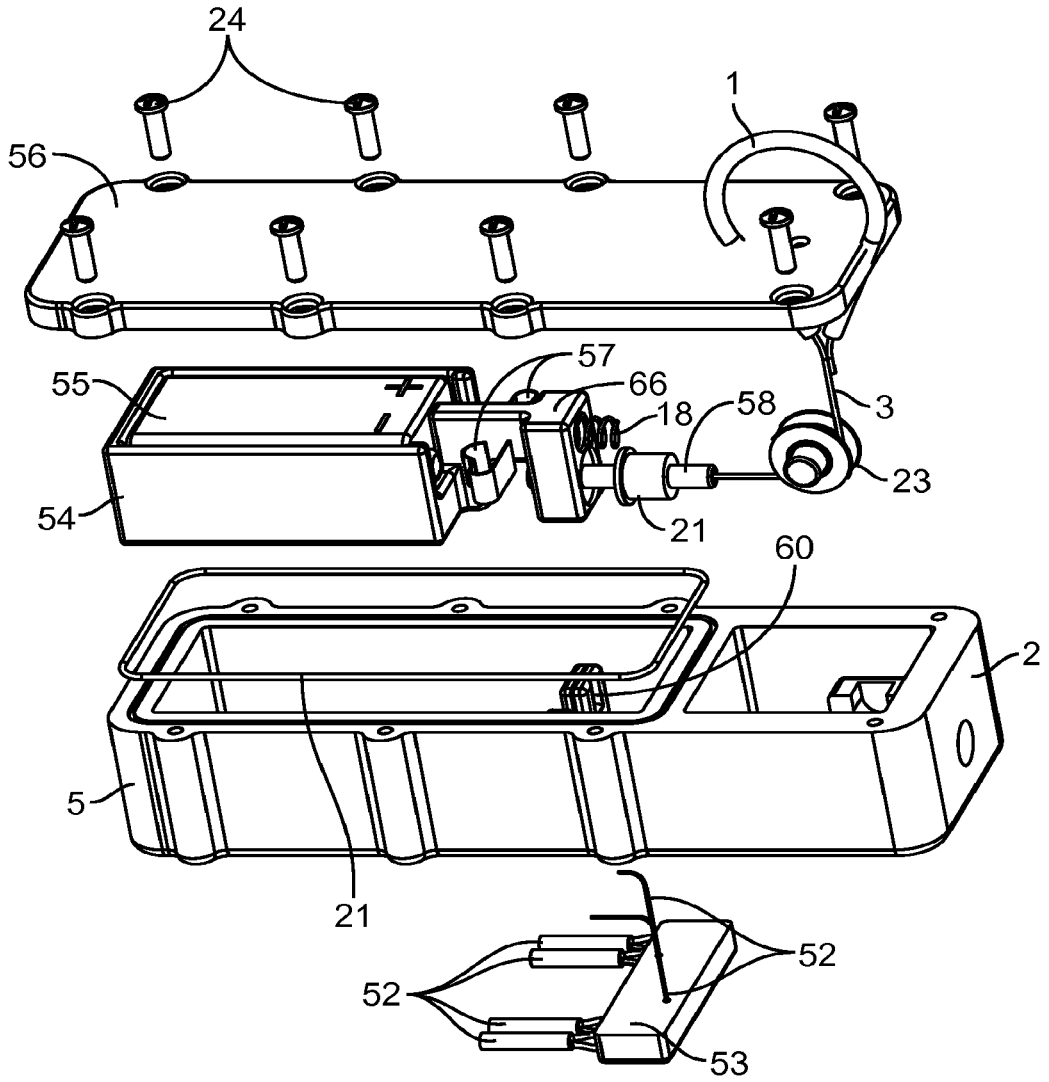
Figure 42:
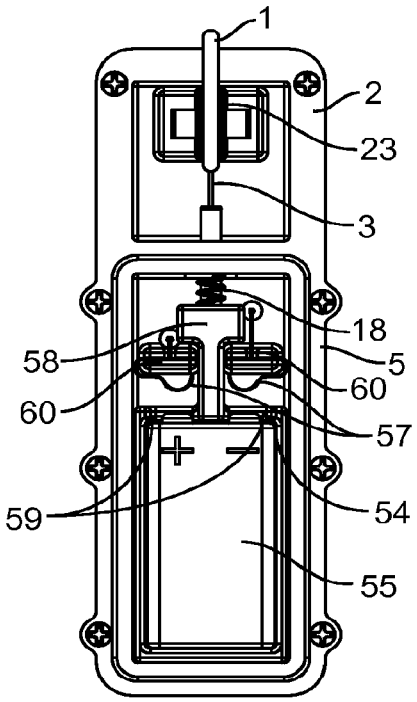
Figure 43:
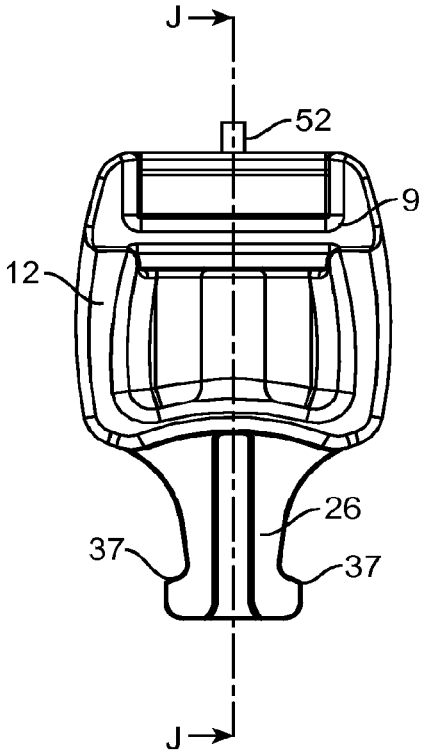
Figure 44:
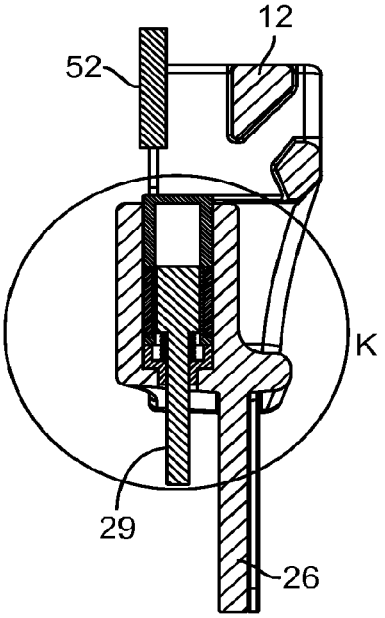
Figure 45:
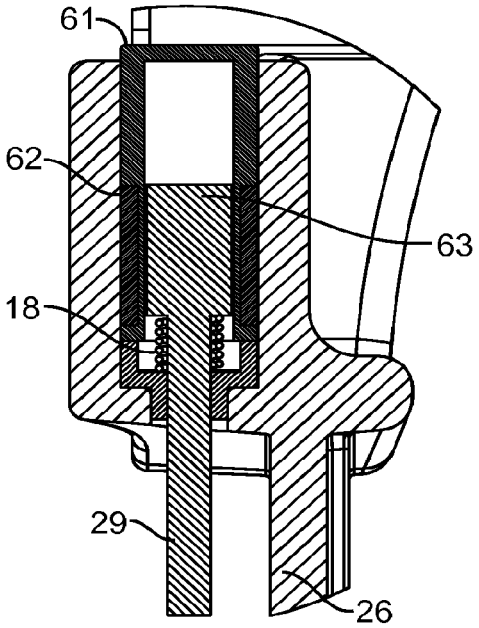

FIG. 41 shows an exploded view. A view from above on the one-piece trigger housing/trigger relay is shown in FIG. 42 whereby the closure cover has been removed in this illustration to allow a view into the interior of the common housing. The operation of the trigger casing 2 and trigger relay 5 in this example embodiment is explained with reference to FIG. 41 and FIG. 42. Trigger 1 is connected via the inner cable 3 and the turn-around roller 23 to the tension rod 58. This in turn is moved in a seal 21 or other guide. The tension rod 58 is connected to the operating element 66. This in turn is attached to the battery housing 54. The return spring 18 is also arranged on the operating element 66. Via corresponding holders 60 the electrical contacts 57 are attached in the trigger relay 5. The battery 55 is held in the battery housing 54 and is arranged in the trigger relay housing 54 moveably relative to the electrical contacts 57 and their holders 60. In the shown example embodiment the closing cover 56 is attached to the remainder of the housing by means of screws 24. The electrical contacts 57 are attached via corresponding electrical connection leads 52 to the electrical distributor 53, which is provided for forwarding the electrical signals in the individual electrical connection cables 52. FIG. 43 to FIG. 45 show a male portion 9 of an attachment assembly 8 which can be used together with the trigger relay 5 of this example embodiment. The corresponding female parts 10 of the attachment arrangement 8 are not shown here. They can be designed as shown in FIG. 21 to FIG. 30. FIG. 43 shows a view from above on the male portion 9 with its front end 26 and the collars 32 arranged on it which when inserted into the female portion act 10 together with the second levers 34 and anchor the male portion 9 in the female portion 10. FIG. 44 shows the cross-section along line J-J in FIG. 43. FIG. 45 shows the detail K in FIG. 44 enlarged.

As can be seen in particular in FIG. 44 and FIG. 45, in this example embodiment the electrical connection cable 52 leads to a magnetic coil casing 61 or its winding 62 in the male portion 9. The piston 63 is arranged within a preferably cylindrical recess in the magnetic coil casing 61 and can be made of a permanent magnetic or magnetizable material. The plunger 29 is attached to the piston 63, in one piece in the shown example embodiment. The return spring 18 is arranged between the piston 63 and the front end of the preferably cylindrical recess in the magnetic coil casing 61. The piston 63, together with the plunger 29, is arranged moveably parallel to the front end 26 in the magnetic coil casing 61. FIG. 44 to FIG. 45 show piston 63 and plunger 29 in the maximum extended position in which the piston 62 is between the winding 62. In the retracted position of the plunger 29 and piston 63, which is not shown here, the latter is on the side of the winding 62 facing away from the return spring 18.

In order to move the piston rod 29 from its retracted position into the extended position shown in FIG. 45 and thereby open the above-described level mechanism of the female portion of the attachment assembly 9 and push the male portion 9 out of the female portion 10, the trigger 1 can be pulled. This pulls the tension rod 58 together with the operating element 66 and the battery housing 54 attached to it in the direction of the turn-around roller 23. This compresses the return spring 18. By pulling on the trigger 1, through the movement of the battery housing 54 and battery 55, the electrical battery contacts 59 come into contact with the electrical contacts 57 fixed to the trigger relay 5. This produces a flow of current via the electrical connection cable 52 into the electrical distributor 53, which via the electrical connection cables 52 is forwarded to the connected number of attachment assemblies 8, or in the shown example embodiment to their male portions 9. As a result of this, in the attachment assemblies 8, or in the shown example embodiment in their male portions 9, electrical current flows through the respective winding 62; which builds up a magnetic field that pulls the piston 63 from the retracted position (not shown) into the extended position shown in FIG. 44 and FIG. 45. By this movement of piston 63 the plunger 29 is moved into the position shown in FIG. 44 and FIG. 45, where, with reference to FIG. 27 to FIG. 30, it acts on the coupling piece 36 and thereby pivots the levers 33 and 34 into the opening position in order to release the front end 26 of the male portion 9, whereby preferably the male portion 9 is already pushed partly out of the female portion 10 by the movement of the plunger 29 so that the male portion 9 can then be completely pulled out of the corresponding female portions 10 of the attachment assembly 8. If the trigger 1 is now released, the return spring 18 pushes the tension rod 58 and operating element 66 and battery housing 54 as well as battery 55 back so that the electrical connection between the electrical contacts 57 and the electrical battery contacts 59 is broken. The current flow stops and the return spring 18 arranged in the magnetic coil casing 61 pushes the piston 62 and plunger 29 back into the retracted position.

Figure 46:
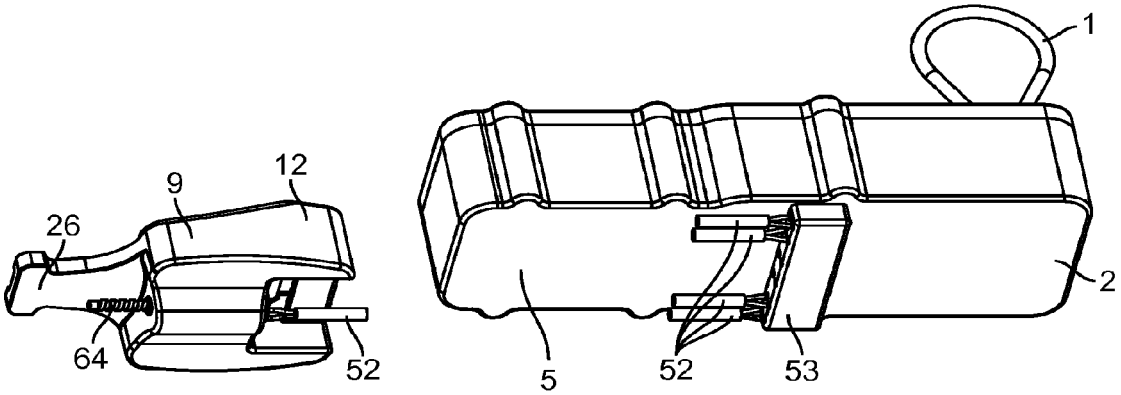
FIG. 46 to FIG. 53 depict embodiments according to the technology on the basis of electrical signal transmission.
Figure 47:
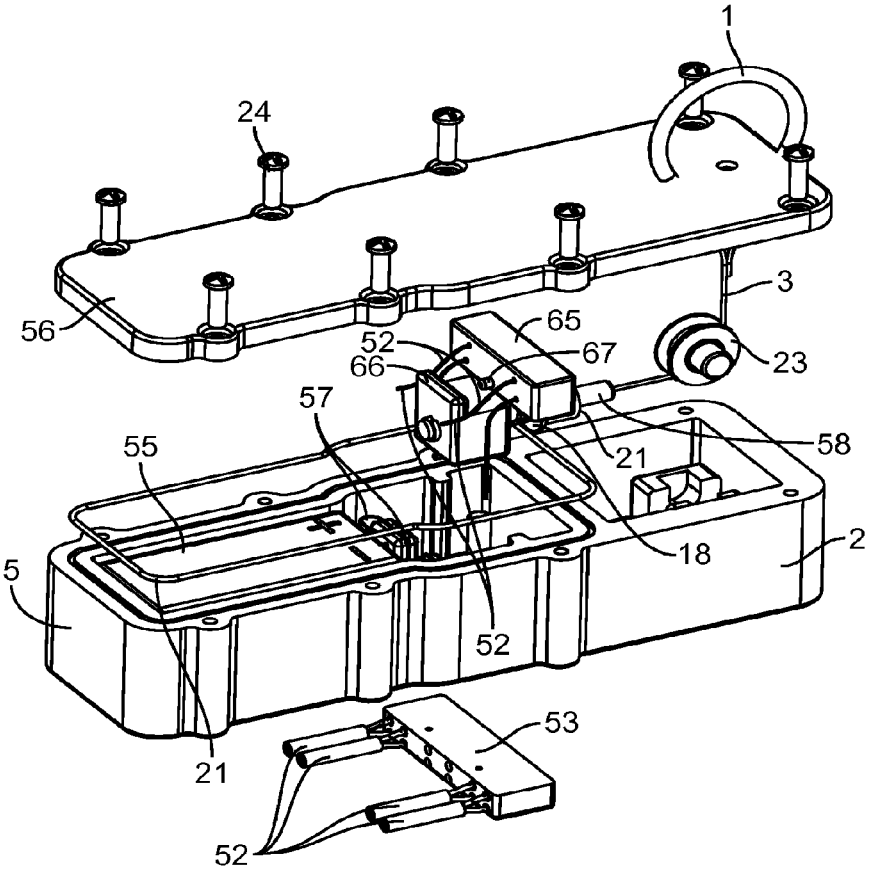
Figure 48:
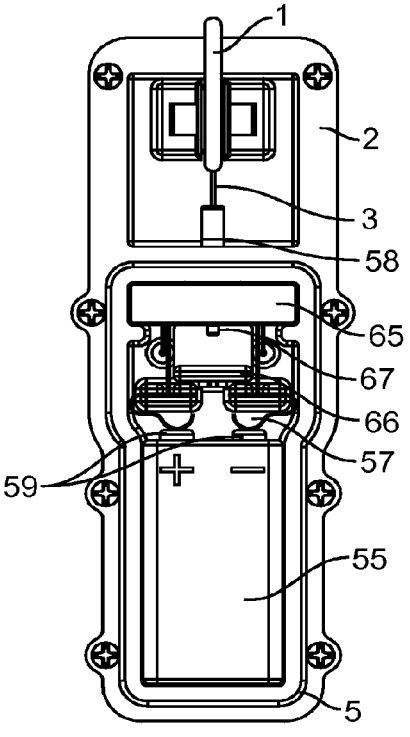
Figure 49:
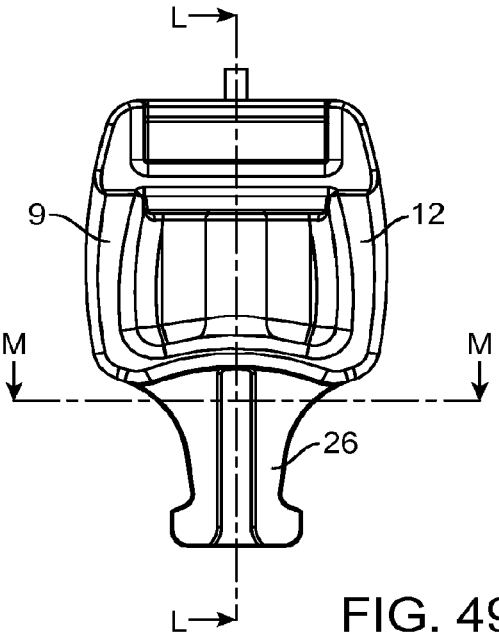
Figure 50:
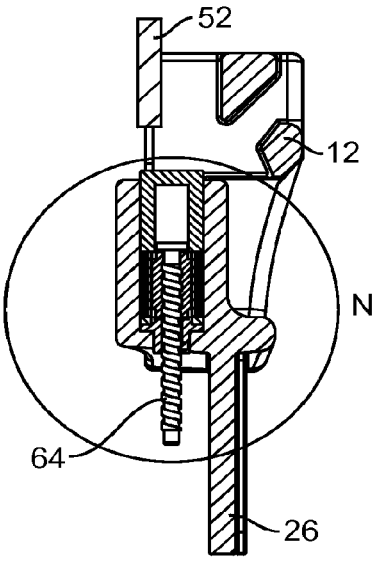
Figure 51:
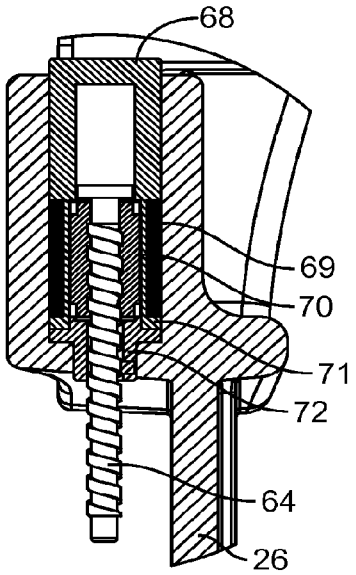
Figure 52:
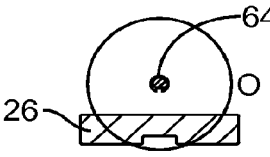
Figure 53:
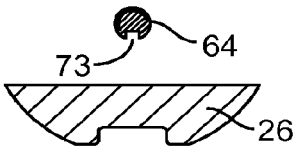

FIG. 46 to FIG. 53 show a further example embodiment of an attachment system with remote triggering in which electrical operation is envisaged for opening the attachment assembly/assemblies 8. FIG. 46 shows a view from below of the integrated housing for the trigger 2 and trigger relay, 5 and a male portion 9, selected as an example, of an attachment assembly 8. FIG. 47 shows an exploded view of the trigger housing 2 and trigger relay 5. FIG. 48 shows a view from above in which the closing cover 56 has been removed. FIG. 49 shows a view from above on a suitable male portion 9 of a suitable attachment assembly 8 for this example embodiment. FIG. 50 shows the cross-section along line L-L in FIG. 49. FIG. 51 shows enlarged area N in FIG. 50. FIG. 52 shows the cross-section along line M-M in FIG. 49. FIG. 53 shows an enlargement of detail 0 in FIG. 52.

As in the example embodiment described above, an electrical distributor 53 is arranged on the trigger relay 5 in this example which allows the required number of attachment assemblies 8 or male portions 9 to be connected to the trigger relay 5. Even though in this example only one male portion 9 is shown, it is nevertheless clear that via appropriate electrical connection cables 52 any required number of attachment assemblies 8 or male portions 9 can be connected to a single trigger relay 5. For this the distributor 53 only has to have a corresponding number of connections for electrical connection cables 52. On the male portion 9, instead of the plunger 29 in the last example embodiment, a spindle 64 is provided, the function of which will be explained below. In this example embodiment, showing the corresponding female portions 10 of the attachment assemblies 8 separately has again been dispensed with. The female portions 10 shown and explained in FIG. 10 to FIG. 30 can be used. Different designs of this form of embodiment are also possible, in which the trigger housing 2 and trigger relay 5 are separate from each other and are connected for example by means of a Bowden cable as in the first example embodiment according to FIG. 12 to FIG. 15. With the aid of FIG. 47 and FIG. 48 the design and function of the trigger housing 2 and trigger relay 5 in this example embodiment will now be explained. The trigger 1 is connected via an inner trigger cable 3, guided via the rotating turn-around roller 23 arranged in the trigger housing 2, with a tension rod 58. An operating element 66 is attached to the tension rod 58. The tension rod 58 moves in a corresponding seal 21 or guide. The tension rod 58 and operating element 66 are moveable and, more particularly, are arranged moveably relative to the electrical relay 65 in the housing. The electrical relay 65 is on the one hand connected via corresponding connection cables 52 to the electrical contacts 57 and on the other hand connected via other connection cable 52 with the electrical distributor 53. The electrical relay 65 has a push button 67 with which it can be operated. In the example embodiment the battery 55 is fixed in the trigger relay 55. The electrical contacts 57 are permanently connected to the electrical battery contact 59.

The electrical signals distributed via the electrical distributor 53 to the individual electrical cables 52 and the corresponding attachment assemblies 8 or their male portions 9 are as shown in an example in FIG. 49, forwarded to an electric motor in this example embodiment. This electric motor moves the spindle 64. In the specifically shown example the electrical motor has a motor housing 68 in which the spindle 64 is arranged to move longitudinally. A fixed winding 70 is provided on the motor housing 68. Within this an anchor 69 with an internal thread is arranged in a rotating manner. This internal thread of this anchor 69 engages in the external thread of the spindle 64.

At the front end of the winding 70 and anchor 69 a motor cover 71 is provided. This has a radial bolt 72 that engages in the longitudinal groove 72, shown in FIG. 52 and FIG. 53, of the spindle 64. This engaging in the longitudinal groove 73 prevents the spindle 64 from being turned with the anchor 69 and ensures that the rotation of the anchor 69 is converted into longitudinal movement of the spindle 64, preferably parallel to the front end portion 26 of the male portion 9. FIG. 50 and FIG. 51 show the spindle 64 in the extended position. In the retracted position, which is not shown, the spindle 64 is moved back into the motor housing 68.

By pulling the trigger 1 the tension rod 68 and operating element 66 are pushed so far into the trigger relay 5 that the push button 65 of the electrical relay 65 is activated by the operating element. Via a corresponding electrical circuit in the electrical relay 65 an operating cycle is triggered in which the spindle 64 is initially moved from its retracted position into its extended position shown in FIG. 50 to FIG. 51. As a result of this the spindle 64 is pressed against the coupling piece 36 of the corresponding female portion 10 shown in FIG. 10 to FIG. 30, whereby the corresponding levers 33, 34 of the female portion 10 are pivoted into the opening position and the front end 26 of the male portion 9 is released. By moving the spindle 64 further the male portion 9 is pushed partly out of the female portion 10 so that the second levers 34 can no longer come into contact with the collars 37 of the T-shaped front end 26 of the male portion 9. This prevents accidental re-engagement of the levers 34. The attachment assembly 8 therefore remains in the open position so that the male portion 9 can be pulled out of the female portion 10 and even after retraction of the spindle 64 into the motor casing 68 the male portion 9 will not engage again in the female portion 10 as long as it is not pushed back by an external force. If the trigger 1 is released after starting the cycle, the return spring 18 shown in FIG. 47 pushes the operating element 66 and tension rod 58 back into the position shown in FIG. 48 whereby the push button 67 is released. Said cycle for extending and retracting the spindle 64 advantageously envisages that retraction of the spindle 64 takes place immediately after its movement into extended position. However via corresponding settings in the electrical relay 5 other control options are conceivable.

The invention claimed is:

1. A system for release of at least one attachment assembly, the system comprising:

a plurality of releasable attachment assemblies, each attachment assembly comprising a releasing means;

at least one trigger; and a plurality of connection assemblies, each connection assembly comprising a relay, a relay-attachment assembly connection for each at least one attachment assembly, and a relay-trigger connection; each connection assembly in communication with a releasing means of one said attachment assembly, and with the trigger, for operation of each releasing means having such communication;

wherein the communication between the connection assembly and the releasing means of at least one attachment assembly comprises a liquid pressure transmission medium relay-attachment assembly connection, and the communication between the connection assembly and the trigger comprises the trigger-relay connection.

2. A personal load carrying assembly, the assembly comprising:

at least one releasable attachment point, the attachment point comprising a releasing means;

at least one trigger; and at least one connection assembly, each connection assembly comprising a relay, a relay-attachment assembly connection for each at least one attachment assembly, and a relay-trigger connection; each connection assembly in communication with a releasing means of at least one attachment assembly, and with the trigger, for operation of each releasing means having such communication;

wherein the communication between the connection assembly and the releasing means of at least one attachment assembly comprises a liquid pressure transmission medium relay-attachment assembly connection, and the communication between the connection assembly and the trigger comprises the trigger-relay connection.

* * * * *